US011658372B2

(12) United States Patent
Kosaka

(10) Patent No.: US 11,658,372 B2
(45) Date of Patent: May 23, 2023

(54) TRANSMISSION LINE AND ANTENNA

(71) Applicant: NEC CORPORATION, Tokyo (JP)

(72) Inventor: Keishi Kosaka, Tokyo (JP)

(73) Assignee: NEC CORPORATION, Tokyo (JP)

( * ) Notice: Subject to any disclaimer, the term of this patent is extended or adjusted under 35 U.S.C. 154(b) by 50 days.

(21) Appl. No.: 17/253,420

(22) PCT Filed: Jun. 25, 2019

(86) PCT No.: PCT/JP2019/025217
§ 371 (c)(1),
(2) Date: Dec. 17, 2020

(87) PCT Pub. No.: WO2020/004409
PCT Pub. Date: Jan. 2, 2020

(65) Prior Publication Data

US 2021/0257706 A1 Aug. 19, 2021

(30) Foreign Application Priority Data

Jun. 29, 2018 (JP) ..... JP2018-124480

(51) Int. Cl.
*H01Q 15/14* (2006.01)
*H01P 1/20* (2006.01)
*H01Q 19/10* (2006.01)

(52) U.S. Cl.
CPC ..... *H01P 1/20* (2013.01); *H01Q 19/10* (2013.01)

(58) Field of Classification Search
CPC .... H01P 1/20; H01P 3/06; H01Q 1/52; H01Q 15/14; H01Q 19/10
See application file for complete search history.

(56) References Cited

U.S. PATENT DOCUMENTS 3,789,404 A * 1/1974 Munk ..... H01Q 15/0013 343/872
4,897,664 A * 1/1990 Killackey ..... H01Q 1/28 343/837
5,448,253 A * 9/1995 Ponce de Leon ..... H01Q 1/243 343/702
5,563,616 A * 10/1996 Dempsey ..... H01Q 9/285 343/756
5,982,339 A 11/1999 Lalezari et al.
7,190,315 B2 * 3/2007 Waltho ..... H01Q 1/28 343/705
9,496,606 B2 * 11/2016 Iso ..... H01P 3/087
10,971,802 B2 * 4/2021 Kim ..... H01Q 1/246
11,342,682 B2 * 5/2022 Pelletti ..... H01Q 1/007

FOREIGN PATENT DOCUMENTS

JP 2000-514614 A 10/2000
JP 2006-339759 A 12/2006
JP 2011-222253 11/2011
(Continued)

OTHER PUBLICATIONS

Japanese Office Action for JP Application No. 2020-527551 dated May 25, 2021 with English Translation.
(Continued)

*Primary Examiner* — Tho G Phan
(74) *Attorney, Agent, or Firm* — Sughrue Mion, PLLC

(57) ABSTRACT

A transmission line having, for example, a first frequency-selecting surface.

6 Claims, 23 Drawing Sheets

(56) References Cited

FOREIGN PATENT DOCUMENTS

| | | | |
|---|---|---|---|
| JP | 2015-162689 | A | 9/2015 |
| JP | 2018-502301 | A | 1/2018 |
| WO | 2014/059946 | A1 | 4/2014 |
| WO | 2017/056437 | A1 | 4/2017 |

OTHER PUBLICATIONS

Jun H. Choi et al., "Vialess composite right/left-handed stripline and its applications for broadband 3-dB and tunable couplers", 2014 44th European Microwave Conference, 2014, pp. 315-318.
International Search Report for PCT/JP2019/025217 dated, Sep. 10, 2019 (PCT/ISA/210).
Japanese Office Action for JP Application No. 2020-527551 dated Jul. 27, 2021 with English Translation.

* cited by examiner

TRANSMISSION LINE AND ANTENNA

CROSS REFERENCE TO RELATED APPLICATIONS

This application is a National Stage of International Application No. PCT/JP2019/025217 filed Jun. 25, 2019, claiming priority based on Japanese Patent Application No. 2018-124480 filed Jun. 29, 2018, the entire disclosure of which is incorporated herein by reference.

TECHNICAL FIELD

The present invention relates to a transmission line and an antenna.

BACKGROUND ART

The use of a transmission line for supplying power to an antenna or the like is known.

For example, Patent Document 1 discloses the use of a transmission line for supplying power to a multi-band antenna of a wireless communication device.

CITATION LIST

Patent Literature

[Patent Document 1]
WO 2014/059946 A1

SUMMARY OF THE INVENTION

Problems to be Solved by the Invention

In the embodiment in Patent Document 1, for example, the transmission line is provided in a space through which electromagnetic waves travel, and thus may affect the characteristics of the electromagnetic waves.

An example objective of an embodiment in the present disclosure is to provide a transmission line and an antenna that solve one of the above-mentioned problems.

Means for Solving the Problems

The transmission line according to an embodiment in the present disclosure has a frequency-selecting surface.

Advantageous Effects of Invention

According to an embodiment in the present disclosure, for example, even when a transmission line is provided in a space through which electromagnetic waves travel, the characteristics of the electromagnetic waves are not easily affected.

EXAMPLE EMBODIMENT

All of the embodiments in the present disclosure are merely exemplary, and are neither intended to exclude other examples from the present disclosure, nor intended to limit the technical scope of the inventions recited in the claims.

There may be some cases in which descriptions relating to combinations of embodiments in the present disclosure are partially omitted.

Such omissions are intended to simplify the explanation, and are neither intended to exclude such combinations from the present disclosure, nor to limit the technical scope of the inventions recited in the claims.

Regardless of whether or not they are omitted, all combinations of the embodiments in the present disclosure are explicitly, implicitly or inherently included in the present disclosure.

In other words, regardless of whether or not they are omitted, all combinations of embodiments in the present disclosure can be directly and clearly derived from the present disclosure.

For example, a transmission line according to an embodiment in the present disclosure may have a first frequency-selecting surface.

Figure 1:
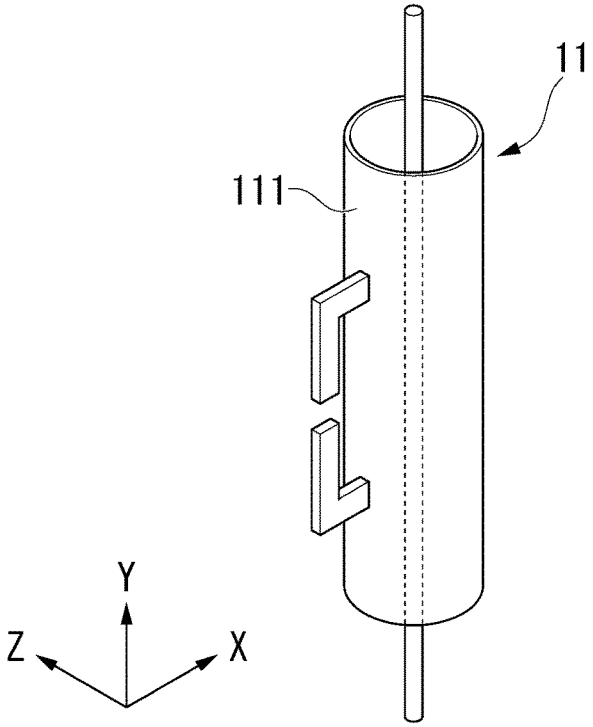
FIG. 1 is a perspective view of an example of a transmission line according to an embodiment in the present disclosure.

FIG. 1 is a perspective view of an example of a transmission line according to an embodiment in the present disclosure.

Figure 2:
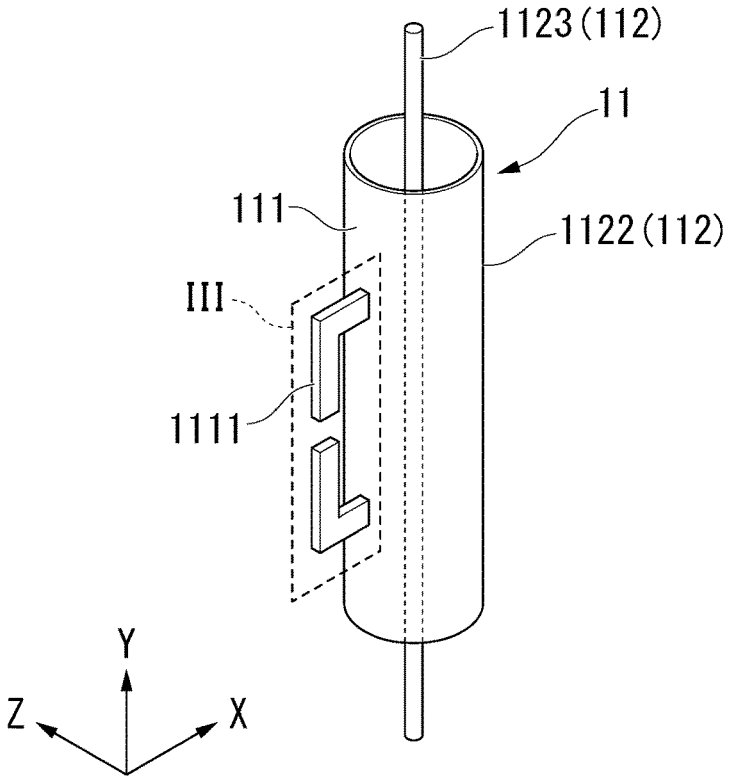
FIG. 2 is a perspective view of an example of a transmission line according to an embodiment in the present disclosure.

FIG. 2 is a perspective view of an example of a transmission line according to an embodiment in the present disclosure.

Figure 3:
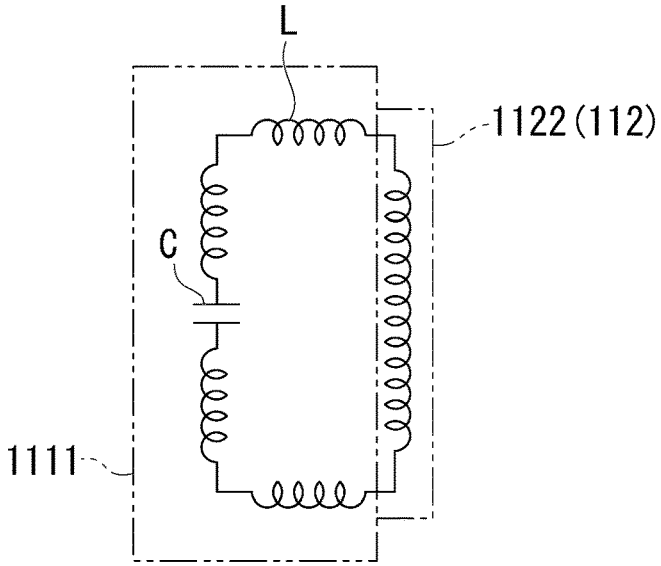
FIG. 3 is an example of an equivalent circuit of part III in FIG. 2.

FIG. 3 is an example of an equivalent circuit of part III in FIG. 2.

For example, the transmission line according to an embodiment in the present disclosure may be a first transmission line 11.

For example, the first transmission line 11 may be extended in the Y-axis direction.

For example, the direction of extension of the first transmission line 11 will be referred to as the Y-axis direction.

For example, a radial direction from the first transmission line 11 will be referred to as the X-axis direction.

For example, a direction orthogonal to the X-axis direction and orthogonal to the Y-axis direction will be referred to as the Z-axis direction.

For example, the first transmission line 11 may have a first frequency-selecting surface 111.

For example, the first frequency-selecting surface 111 may be an FSS (Frequency Selective Surface).

For example, the FSS has a conductor, a conductor and a dielectric, or a periodic structure thereof.

For example, the FSS may have the function of selectively passing electromagnetic waves in a specific frequency band.

For example, the first frequency-selecting surface 111 may be configured so that the first transmission line 11 allows electromagnetic waves of a certain frequency to pass.

For example, the first transmission line 11 may be provided with a conductor 112.

For example, the conductor 112 may extend in the Y-axis direction.

For example, the conductor 112 may be provided with a ground conductor 1122 and a core wire 1123.

For example, the ground conductor 1122 may extend in the Y-axis direction.

For example, the core wire 1123 may extend in the Y-axis direction.

For example, the ground conductor 1122 may cover the outer circumference of the core wire 1123 over the entire circumference about the Y-axis direction.

For example, the central axis of the ground conductor 1122 extending in the Y-axis direction and the central axis of the core wire 1123 extending in the Y-axis direction may be coaxial.

For example, the inner circumference of the ground conductor 1122 and the outer circumference of the core wire 1123 may be electrically isolated by space, a dielectric or the like.

For example, a space between the inner circumference of the ground conductor 1122 and the outer circumference of the core wire 1123 may be entirely or at least partially filled with a dielectric so as to extend in the Y-axis direction.

For example, the first transmission line 11 may be a coaxial cable having the ground conductor 1122 as an outer conductor and the core wire 1123 as an inner conductor.

For example, the first frequency-selecting surface 111 may include a three-dimensional pattern 1111.

For example, the first frequency-selecting surface 111 may allow electromagnetic waves having a certain frequency to pass by a combination of the surface of a ground conductor 1122 and a three-dimensional pattern 1111.

For example, if the frequency of incident electromagnetic waves is a frequency that matches or is close to the resonance frequency of the first frequency-selecting surface 111, then reradiation occurs. For this reason, when the electromagnetic waves are incident on the first frequency-selecting surface 111, they are passed to the opposite side of the first frequency-selecting surface 111.

For example, the ground conductor 1122 and the three-dimensional pattern 1111 may be combined with each other so as to form an equivalence circuit having a capacitance component C and an inductance component L as illustrated in FIG. 3. In this way, the ground conductor 1122 and the three-dimensional pattern 1111 can be treated as equivalent to a series circuit comprising an inductance component L and a capacitance component C.

For example, the three-dimensional pattern 1111 may be a combination of two metallic plates that are arranged to be close to each other so as to have a gap therebetween.

For example, the three-dimensional pattern 1111 may be a combination of two metallic plates that are L-shaped.

Figure 4:
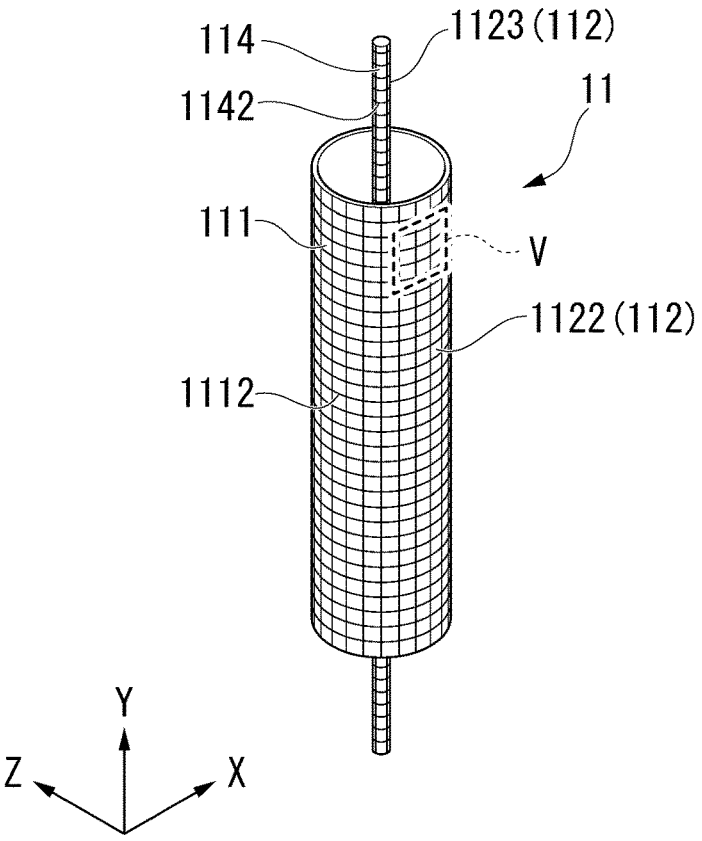
FIG. 4 is a perspective view of an example of a transmission line according to an embodiment in the present disclosure.

FIG. 4 is a perspective view of an example of a transmission line according to an embodiment in the present disclosure.

Figure 5:
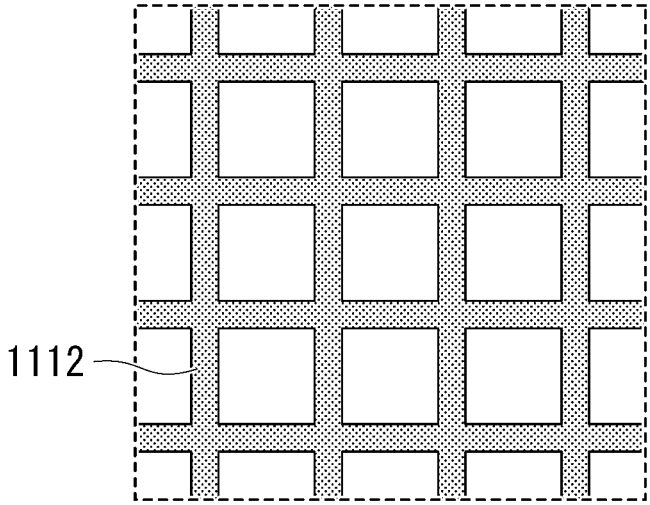
FIG. 5 is an enlarged view of part V in FIG. 4.

FIG. 5 is an enlarged view of part V in FIG. 4.

Figure 6:
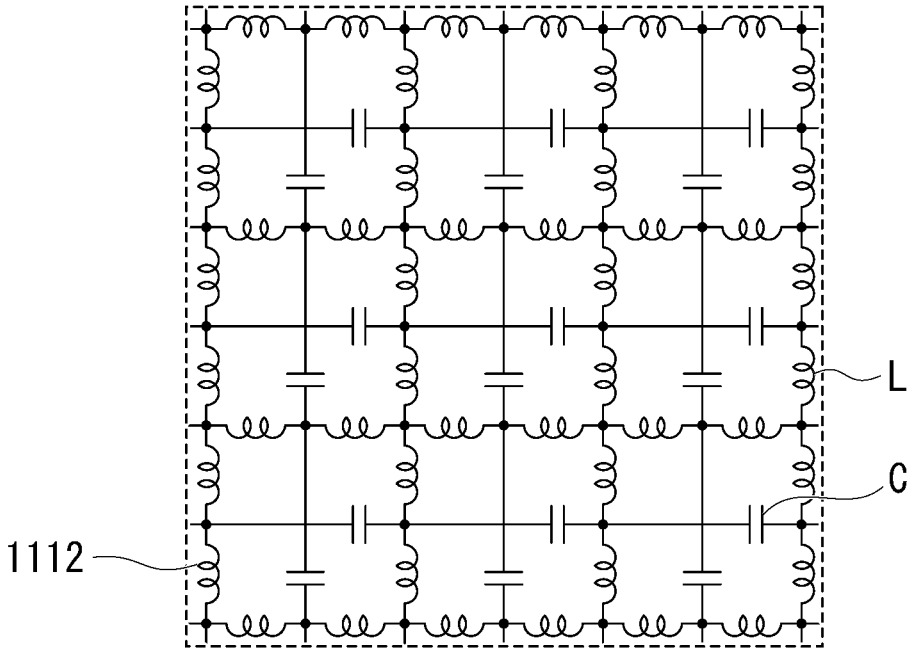
FIG. 6 is an example of an equivalent circuit of part V in FIG. 4.

FIG. 6 is an example of an equivalent circuit of part V in FIG. 4.

For example, the first frequency-selecting surface 111 may be a surface mainly comprising a repeating structure of a metallic pattern, and may have a surface structure that allows electromagnetic waves of a certain frequency to pass.

For example, the first frequency-selecting surface 111 may be a sheet.

For example, the first frequency-selecting surface 111 may include a grid pattern 1112 comprising a repeating structure.

For example, the first frequency-selecting surface 111 may allow electromagnetic waves of a certain frequency to pass by means of the grid pattern 1112.

For example, the outer circumferential surface of the ground conductor 1122 may be a grid pattern 1112.

For example, the grid pattern 1112 may be a combination of conductor patterns in which multiple conductor patterns extending in the Y-axis direction and multiple conductor patterns extending in the circumferential direction about the Y-axis direction intersect each other, as illustrated in FIG. 4 and FIG. 5.

For example, the first frequency-selecting surface 111 may be composed of a mesh structure in which unit cells composed of the ground conductor 1122 and apertures provided in the ground conductor 1122 are arranged periodically.

For example, the portions indicated by the halftone dots illustrated in FIG. 5 indicate the grid pattern 1112.

For example, the apertures may be rectangular, circular, triangular, or another shape.

For example, the ground conductor 1122 and the apertures may form a resonant structure.

For example, in the first frequency-selecting surface 111, the properties of the resonant structure may be adjusted by changing the size of the apertures or the size of the unit cells. By adjusting the properties of the resonant structure, the frequency band of the electromagnetic waves passed by the first frequency-selecting surface 111 may be changed.

For example, in the grid pattern 1112, multiple conductor patterns extending in the Y-axis direction and multiple conductor patterns extending in the circumferential direction about the Y-axis direction may be combined with each other so as to form an equivalence circuit having a capacitance component C and an inductance component L as illustrated in FIG. 6.

For example, multiple conductor patterns extending in the Y-axis direction and multiple conductor patterns extending in a direction orthogonal to the Y-axis direction on the outer circumference may be combined.

For example, as in the first transmission line 11 illustrated in FIG. 4, if the first frequency-selecting surface 111 is a grid pattern 1112, then a second frequency-selecting surface 114 may be provided on the core wire 1123.

For example, the second frequency-selecting surface 114 may allow electromagnetic waves of a certain frequency to pass.

For example, the second frequency-selecting surface 114 may allow electromagnetic waves, to pass, of the same frequency as the electromagnetic waves passed by the first frequency-selecting surface 111.

For example, the second frequency-selecting surface 114 may be a surface, similar to the first frequency-selecting surface 111, mainly comprising a repeating structure of a metallic pattern, and may have a surface structure that allows electromagnetic waves of a certain frequency to pass.

For example, the second frequency-selecting surface 114 may include a grid pattern 1142 similar to the grid pattern 1112.

For example, the frequency of the electromagnetic waves transmitted on the first transmission line 11 and the frequency of the electromagnetic waves passed by the second frequency-selecting surface 114 may be different.

Figure 7:
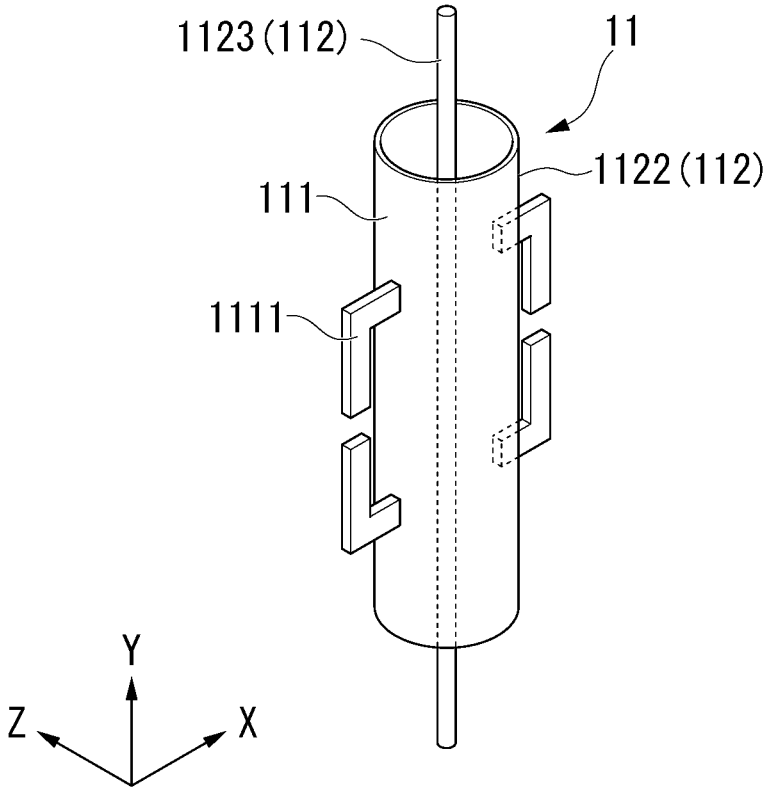
FIG. 7 is a perspective view of an example of a transmission line according to an embodiment in the present disclosure.

FIG. 7 is a perspective view of an example of a transmission line according to an embodiment in the present disclosure.

For example, three-dimensional patterns 1111 may be provided on both sides in a radial direction of the ground conductor 1122.

For example, in FIG. 7, the three-dimensional patterns 1111 are provided on both sides in a radial direction (for example, the X-axis direction) of the ground conductor 1122.

The first transmission line 11 is made transparent with respect to electromagnetic waves of a certain frequency by having the first frequency-selecting surface 111. In other words, electromagnetic waves of a certain frequency pass through the first transmission line 11. For this reason, the first transmission line 11 can suppress the adverse influence that may have on electromagnetic waves of a certain frequency.

Therefore, according to the embodiment in the present disclosure as above, even in cases in which, for example, the transmission line is provided in a space through which electromagnetic waves travel, the transmission line does not tend to affect the characteristics of the electromagnetic waves.

According to an embodiment in the present disclosure, the transmission line has a first frequency-selecting surface that allows electromagnetic waves of a first frequency to pass.

For example, the electromagnetic waves of the first frequency are electromagnetic waves in the direction of extension of the transmission line.

For example, on the transmission line, the first frequency-selecting surface that allows electromagnetic waves of the first frequency to pass covers the outer circumference of the conductor. The second frequency-selecting surface that allows electromagnetic waves of the second frequency to pass is provided on the core wire located inside the conductor. The second frequency may be a frequency in the same frequency band as the first frequency, or may be a frequency in a different frequency band from the first frequency.

In the first transmission line 11 illustrated in FIG. 2, a frequency-selecting surface is formed on the exterior of the ground conductor 1122, thereby electromagnetically covering the interior side (the side with the core wire 1123) of the ground conductor 1122. For this reason, in the first transmission line 11 illustrated in FIG. 2, electromagnetic waves from the outside pass through the transmission line 11 without penetrating into the interior side of the ground conductor 1122.

In the first transmission line 11 illustrated in FIG. 4, the ground conductor 1122 itself is transparent, and electromagnetic waves from the outside sometimes penetrate into the interior side of the ground conductor 1122 (the electromagnetic waves pass through the exterior into the interior of the ground conductor 1122).

For this reason, in the first transmission line 11 illustrated in FIG. 4, for example, the entire first transmission line 11 can be made transparent by also providing a second frequency-selecting surface 114 on the core wire 1123. In other words, the electromagnetic waves from the outside pass through the first transmission line 11.

Although FIG. 2 illustrates a three-dimensional pattern 1111 in which two L-shaped metallic plates are combined, the three-dimensional pattern 1111 may be any combination of patterns as long as an LC circuit can be formed.

For example, the three-dimensional pattern 1111 may have any shape and arrangement, and any number of metallic plates may be combined.

For example, the three-dimensional pattern 1111 is not limited to being a combination of metallic plates, and may be a combination of conductor blocks, a combination of conductor wires, a combination of conductor foil, a combination of conductor patterns on a substrate or the like.

For example, the three-dimensional pattern 1111 may be a combination including at least any of metallic plates, conductor blocks, conductor wires, conductor foil and conductor patterns on a substrate.

For example, an antenna according to the present disclosure may be provided with a transmission line and a reflective plate.

Figure 8:
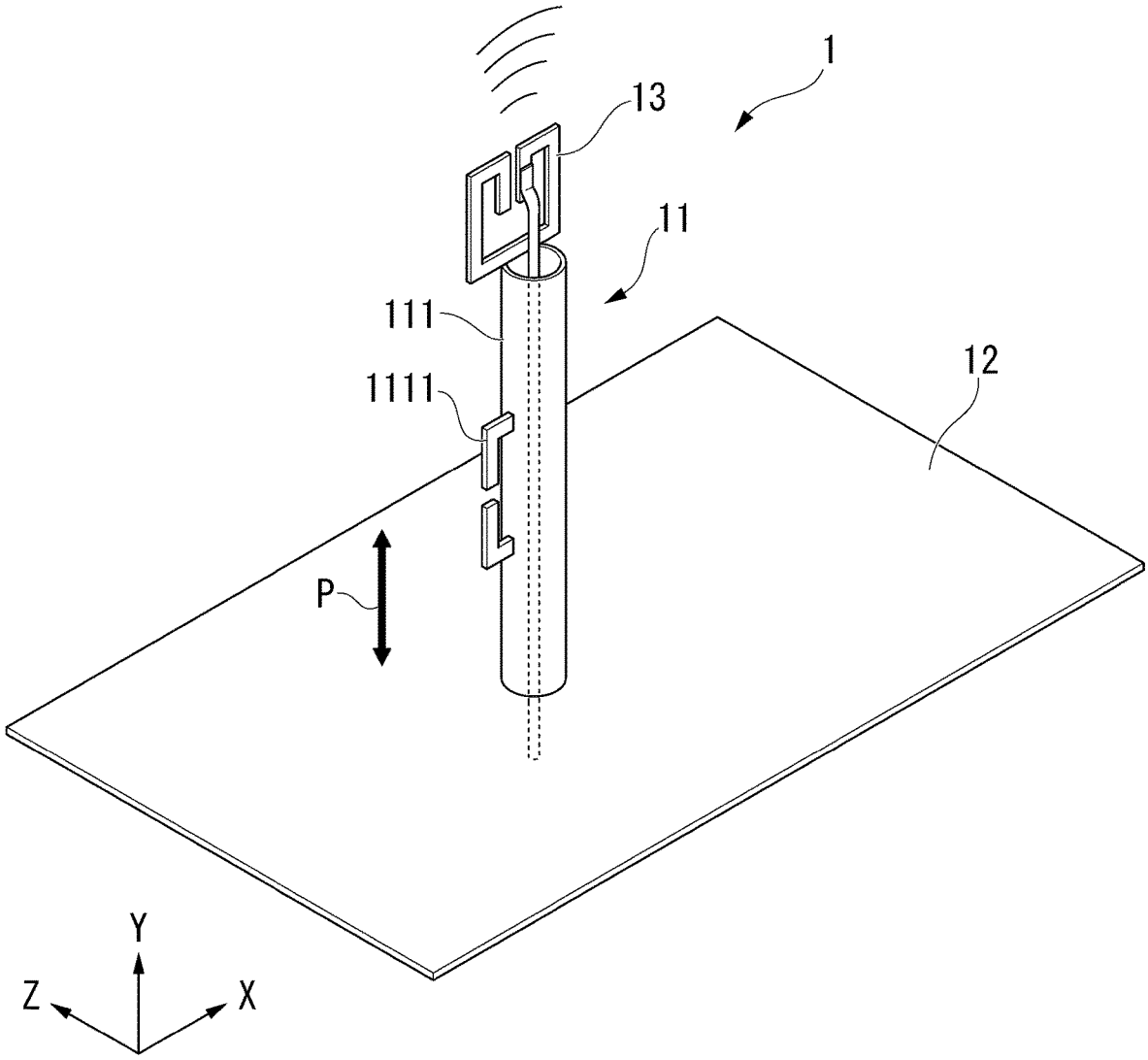
FIG. 8 is a perspective view of an example of a transmission line according to an embodiment in the present disclosure.

FIG. 8 is a perspective view of an example of a transmission line according to an embodiment in the present disclosure.

For example, the antenna 1 may be provided with a first transmission line 11 and a reflective plate 12.

For example, the antenna 1 may be provided with a first antenna element 13.

For example, the antenna 1 may be provided, on one end and the other end in the Y-axis direction of the first transmission line 11, with a first antenna element 13 on one end and a reflective plate 12 on the other end.

For example, the reflective plate 12 may reflect electromagnetic waves.

For example, a plate of the reflective plate 12 may extend on a ZX plane.

For example, the plate surface of the reflective plate 12 may be a conductor.

For example, the electromagnetic waves transmitted on the first transmission line 11 may penetrate through the reflective plate 12.

For example, the first antenna element 13 may transmit electromagnetic waves supplied to the first transmission line 11 into the surrounding space.

For example, the first antenna element 13 may receive electromagnetic waves from the surrounding space. When doing so, the received electromagnetic waves may be transmitted on the first transmission line 11.

For example, the first antenna element 13 may be a split-ring antenna.

By providing the reflective plate 12, among the waves that are polarized in various directions in the electromagnetic waves, at least the waves polarized in the direction parallel to the plate surface of the reflective plate 12 are suppressed. For this reason, the electromagnetic waves directed towards the first transmission line 11 become polarized waves mainly having a direction (for example, the Y-axis direction) intersecting the plate surface of the reflective plate 12 as the polarization direction P.

Therefore, according to the embodiment in the present disclosure as above, for example, the transmission line need only be made transparent in a direction intersecting the plate surface of the reflective plate. Thus, the transmission line can easily be made transparent.

For example, with the three-dimensional pattern 1111 illustrated in FIG. 8, electromagnetic waves having P as the polarization direction easily pass through. For this reason, electromagnetic waves having P as the polarization direction (advancing in a direction substantially parallel to the plate surface of the reflective plate 12) are easily passed to the opposite side of the transmission line, and the transmission line can easily be made transparent.

For example, in the transmission line according to an embodiment in the present disclosure, a first frequency-selecting surface may cover the outer circumference of a conductor.

Figure 9:
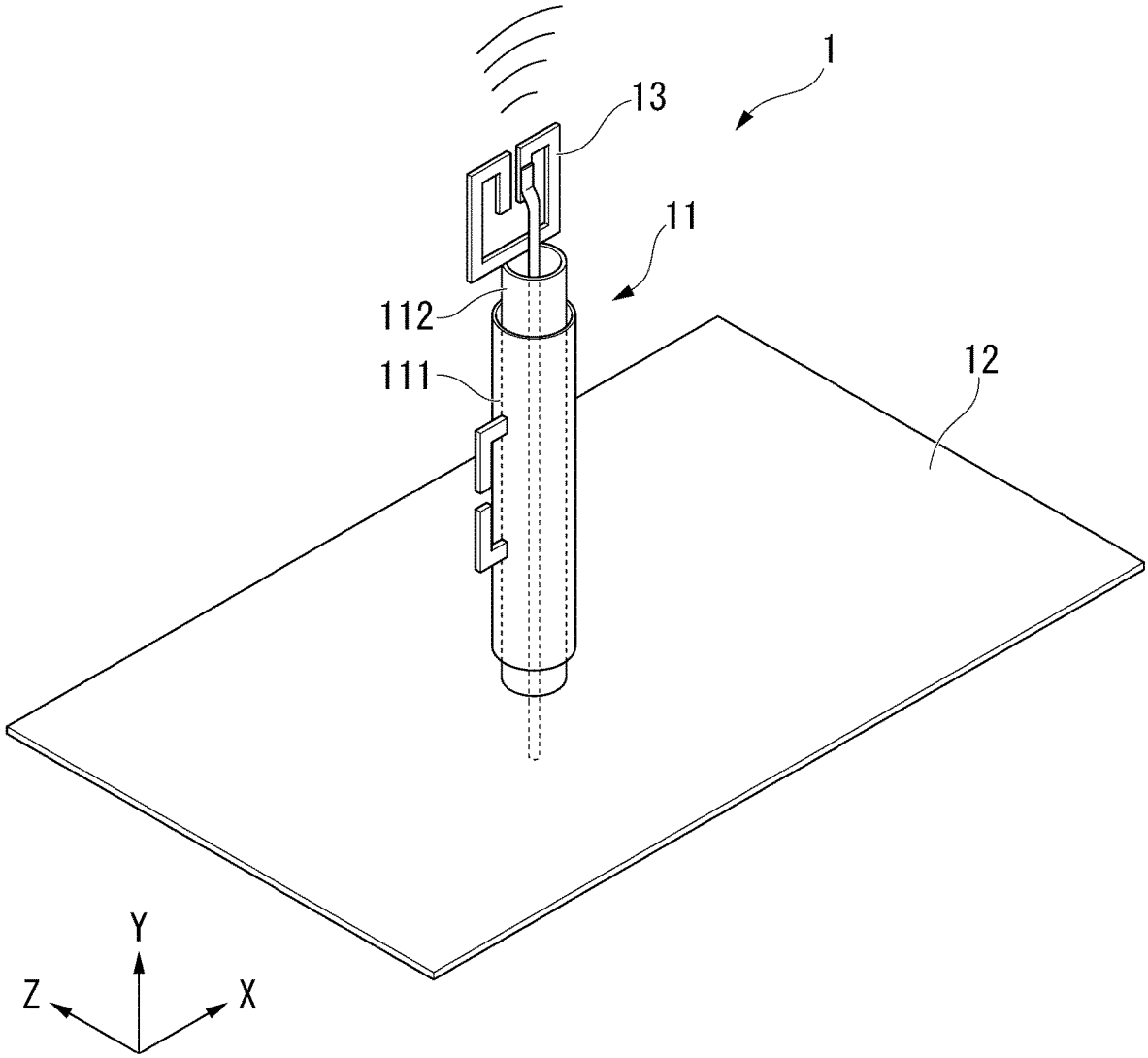
FIG. 9 is a perspective view of an example of a transmission line according to an embodiment in the present disclosure.

FIG. 9 is a perspective view of an example of a transmission line according to an embodiment in the present disclosure.

For example, in the first transmission line 11, the first frequency-selecting surface 111 may cover the outer circumference of the conductor 112.

For example, the first frequency-selecting surface 111 may cover the outer circumference of the ground conductor 1122 over the entire circumference about the Y-axis direction.

For example, the first frequency-selecting surface 111 may be a sheet that covers the outer circumference of the ground conductor 1122 over the entire circumference about the Y-axis direction.

For example, the central axis of the first frequency-selecting surface 111 extending in the Y-axis direction and the central axis of the ground conductor 1122 extending in the Y-axis direction may be coaxial.

For example, the central axis of the first frequency-selecting surface 111 extending in the Y-axis direction, the central axis of the ground conductor 1122 extending in the Y-axis direction and the central axis of the core wire 1123 extending in the Y-axis direction may be coaxial.

For example, the inner circumference of the first frequency-selecting surface 111 and the outer circumference of the ground conductor 1122 may be electrically isolated by space, a dielectric or the like.

For example, a space between the inner circumference of the first frequency-selecting surface 111 and the outer circumference of the ground conductor 1122 may be entirely or at least partially filled with a dielectric so as to extend in the Y-axis direction.

By covering the outer circumference of the conductor 112 with the first frequency-selecting surface 111, the first transmission line 11 can be made transparent without being affected by the structure of the conductor 112. Thus, electromagnetic waves from the outside pass through the first transmission line 11, regardless of the shape of the conductor 112.

Therefore, according to the embodiment in the present disclosure as above, for example, the transmission line can suppress the adverse influence that may have on electromagnetic waves of a certain frequency, without being affected by the structure of the conductor.

FIG. 9 illustrates a reflective plate 12. However, a reflective plate 12 need not be provided as long as the first transmission line 11 can be made transparent.

FIG. 9 illustrates a first antenna element 13. However, a first antenna element 13 need not be provided.

FIG. 9 illustrates the first transmission line 11 applied to a transmission line in an antenna 1. However, the first transmission line 11 may be applied to a transmission line other than that in an antenna.

For example, in the transmission line according to an embodiment in the present disclosure, a first frequency-selecting surface may be provided on a ground conductor.

Figure 10:
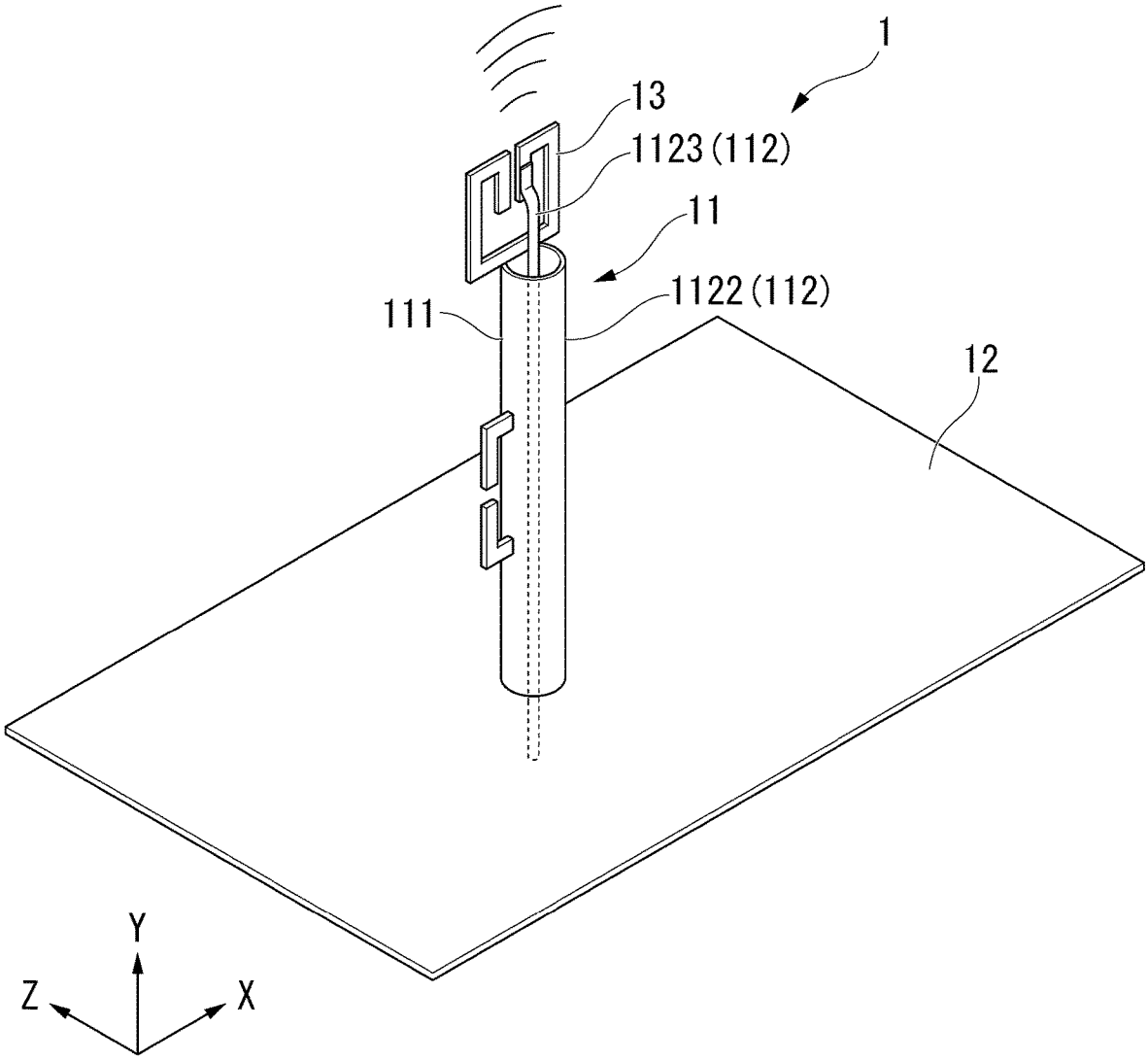
FIG. 10 is a perspective view of an example of a transmission line according to an embodiment in the present disclosure.

FIG. 10 is a perspective view of an example of a transmission line according to an embodiment in the present disclosure.

For example, in the first transmission line 11, the first frequency-selecting surface 111 may be provided on the ground conductor 1122.

For example, the ground conductor 1122 may cover the outer circumference of the core wire 1123 over the entire circumference about the Y-axis direction.

For example, the central axis of the ground conductor 1122 extending in the Y-axis direction and the central axis of the core wire 1123 extending in the Y-axis direction may be coaxial.

For example, the inner circumference of the ground conductor 1122 and the outer circumference of the core wire 1123 may be electrically isolated by space, a dielectric or the like.

For example, a space between the inner circumference of the ground conductor 1122 and the outer circumference of the core wire 1123 may be entirely or at least partially filled with a dielectric so as to extend in the Y-axis direction.

For example, the first transmission line 11 may be a coaxial cable having the ground conductor 1122 as an outer conductor and the core wire 1123 as an inner conductor.

For example, the core wire 1123 may penetrate through the reflective plate 12 so that the electromagnetic waves transmitted on the first transmission line 11 penetrate through the reflective plate 12.

For example, the core wire 1123 and the ground conductor 1122 may each be connected to the first antenna element 13 at locations that are away from each other.

For example, if the first antenna element 13 is a split-ring antenna, the core wire 1123 may be connected to the first antenna element 13 near the split, and the ground conductor 1122 may be connected to the first antenna element 13 at a location away from the split.

Figure 11:
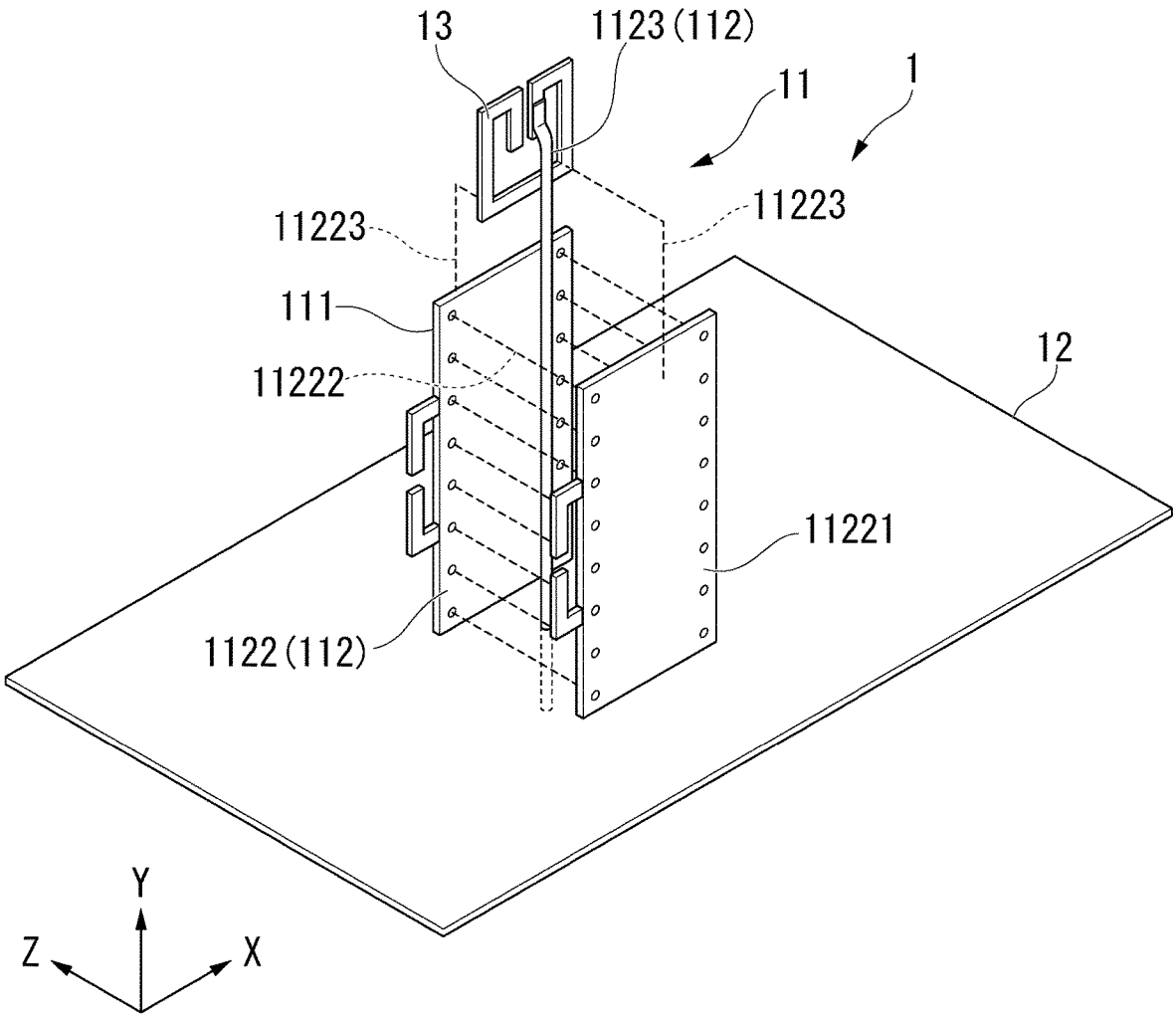
FIG. 11 is a perspective view of an example of a transmission line according to an embodiment in the present disclosure.

FIG. 11 is a perspective view of an example of a transmission line according to an embodiment in the present disclosure.

For example, the ground conductor 1122 may be a pair of opposing planar patterns 11221 that sandwich the core wire 1123 in the Z-axis direction.

For example, each planar pattern 11221 may extend in the Y-axis direction.

For example, each planar pattern 11221 may have a plate surface that extends on the XY plane.

For example, the conductor 112 may be provided with multiple via-holes 11222.

For example, the pair of planar patterns 11221 may be connected to each other through the multiple via-holes 11222.

For example, the pair of planar patterns 11221 may be connected to each other through the multiple via-holes 11222 at both ends in the X-axis direction.

For example, the pair of planar patterns 11221 and the multiple via-holes 11222 may cover the core wire 1123 with respect to electromagnetic waves of a certain frequency that are passed by the first frequency-selecting surface 111.

For example, the central axis of the space sandwiched by the pair of planar patterns 11221 extending in the Y-axis direction and the central axis of the core wire 1123 extending in the Y-axis direction may be coaxial.

For example, the ground conductor 1122 may be provided with a lead wire 11223 or the like so as to be electrically connected to the first antenna element 13.

By providing the first frequency-selecting surface 111 on the ground conductor 1122, the first transmission line 11 is made transparent for electromagnetic waves of a certain frequency. In other words, electromagnetic waves of a certain frequency pass through the first transmission line 11. For this reason, the first transmission line 11 can suppress the adverse influence that may have on electromagnetic waves of a certain frequency.

Therefore, according to the embodiment in the present disclosure as above, even if the transmission line is provided in a space through which electromagnetic waves travel, the transmission line does not tend to affect the characteristics of the electromagnetic waves.

Furthermore, for example, by covering the core wire 1123 with respect to electromagnetic waves of a certain frequency by means of the ground conductor 1122 provided with the first frequency-selecting surface 111, the ground conductor 1122 can be made transparent with respect to electromagnetic waves of a certain frequency, and not only the ground conductor 1122 itself, but at the same time, the core wire 1123 covered by the ground conductor 1122 may also be made transparent FIG. 10 and FIG. 11 both illustrate a reflective plate 12. However, a reflective plate 12 need not be provided as long as the first transmission line 11 can be made transparent.

FIG. 10 and FIG. 11 both illustrate a first antenna element 13. However, a first antenna element 13 need not be provided.

FIG. 10 and FIG. 11 both illustrate the first transmission line 11 applied to a transmission line in an antenna 1. However, the first transmission line 11 may be applied to a transmission line other than that in an antenna.

FIG. 11 illustrates multiple via-holes 11222. However, multiple via-holes 11222 need not be provided as long as the core wire 1123 is covered by the first frequency-selecting surface 111.

FIG. 11 illustrates a first antenna element 13, a core wire 1123 and a pair of planar patterns 11221. However, the first antenna element 13, the core wire 1123 and the pair of planar patterns 11221 may be formed by a single substrate.

FIG. 11 illustrates the core wire 1123 and the pair of opposing planar patterns 11221 that sandwich the core wire 1123 in the Z-axis direction. However, the core wire 1123 and the planar patterns 11221 may be in any form such as a microstrip line, a strip line, a three-dimensional circuit or a coplanar line.

For example, in a transmission line according to an embodiment in the present disclosure, a first frequency-selecting surface may be provided on the ground conductor and a second frequency-selecting surface may be provided on the core wire.

Figure 12:
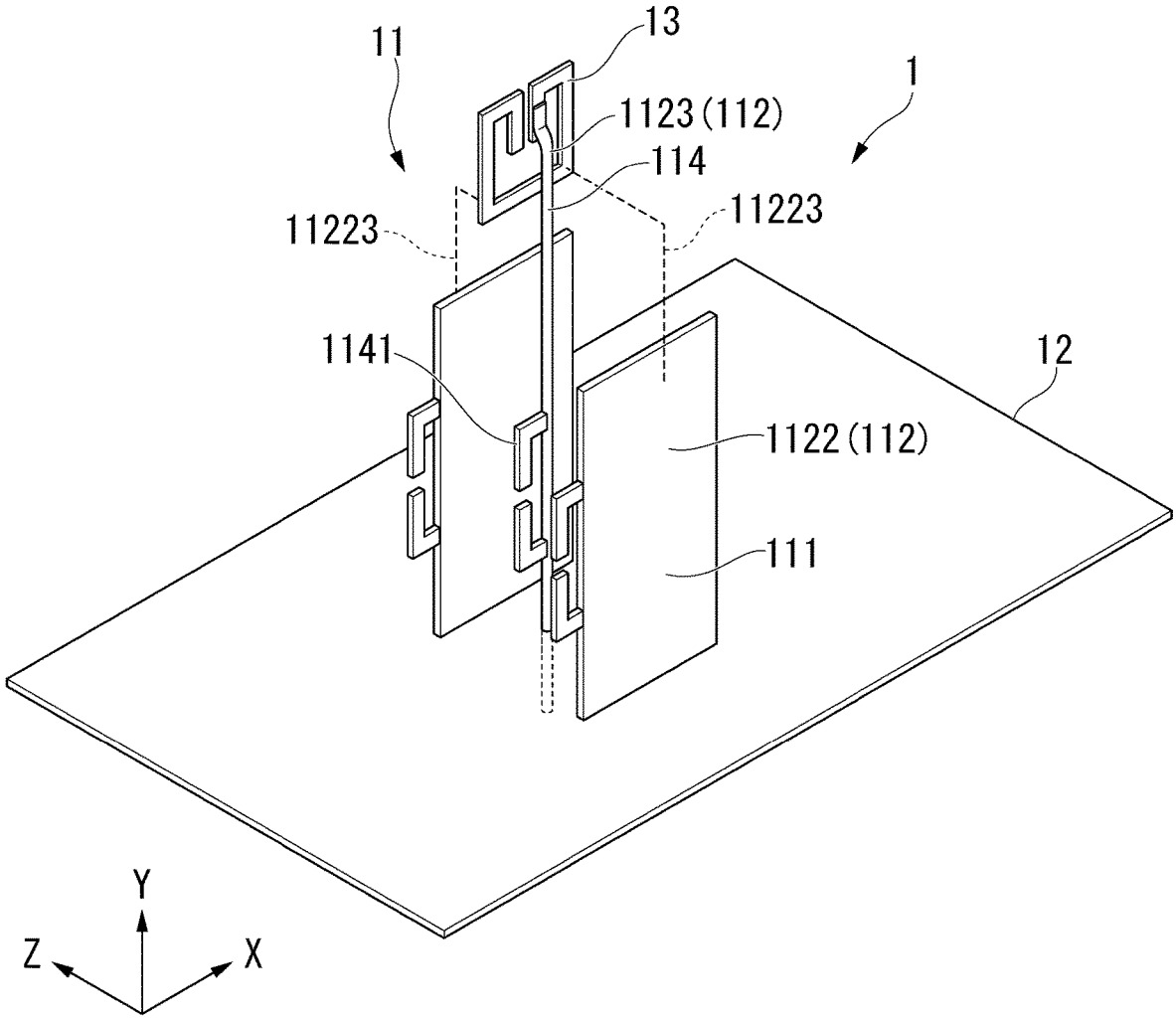
FIG. 12 is a perspective view of an example of a transmission line according to an embodiment in the present disclosure.

FIG. 12 is a perspective view of an example of a transmission line according to an embodiment in the present disclosure.

For example, in the first transmission line 11, the first frequency-selecting surface 111 may be provided on the ground conductor 1122, and the second frequency-selecting surface 114 may be provided on the core wire 1123.

For example, the second frequency-selecting surface 114 may allow electromagnetic waves of a certain frequency to pass.

For example, the second frequency-selecting surface 114 may allow electromagnetic waves, to pass, of the same frequency as the electromagnetic waves passed by the first frequency-selecting surface 111. For example, the second frequency-selecting surface 114 may allow electromagnetic waves, to pass, of a frequency in the same frequency band as the electromagnetic waves passed by the first frequency-selecting surface 111.

For example, the second frequency-selecting surface 114 may include a three-dimensional pattern 1141.

For example, the second frequency-selecting surface 114 may allow electromagnetic waves of a certain frequency to pass by the combination of the surface of the core wire 1123 and the three-dimensional pattern 1141.

For example, the three-dimensional pattern 1141 may be provided on both sides in a radial direction of the core wire 1123. In other words, the three-dimensional pattern 1141 may be provided on both sides in the direction of a diameter of the core wire 1123 orthogonal to the Y-axis direction of the core wire 1123.

For example, the second frequency-selecting surface 114 may include a grid pattern as illustrated in FIG. 4, FIG. 5 or FIG. 6.

For example, the second frequency-selecting surface 114 may allow electromagnetic waves of a certain frequency to pass by means of the grid pattern.

For example, the surface of the core wire 1123 may be a grid pattern.

For example, a pair of planar patterns 11221 (FIG. 11) may cover or may not cover the core wire 1123 with respect to electromagnetic waves of a certain frequency that are passed by the first frequency-selecting surface 111.

The first transmission line 11 is made transparent with respect to electromagnetic waves of a certain frequency by having a first frequency-selecting surface 111 and a second frequency-selecting surface 114. In particular, the ground conductor 1122 is made transparent by the first frequency-selecting surface 111, and the core wire 1123 is made transparent by the second frequency-selecting surface 114. For this reason, for electromagnetic waves of the certain frequency, even if the core wire 1123 is not covered by the ground conductor 1122, the first transmission line 11 is made transparent. In other words, electromagnetic waves of the certain frequency pass through the first transmission line 11.

Therefore, according to the embodiment in the present disclosure as above, the transmission line will not tend to affect the characteristics of electromagnetic waves, even when the transmission line is provided in a space through which electromagnetic waves travel, regardless of, for example, the relationship between the ground conductor and the core wire, such as the arrangement and the structures thereof.

FIG. 12 illustrates a reflective plate 12. However, a reflective plate 12 need not be provided as long as the first transmission line 11 can be made transparent.

FIG. 12 illustrates a first antenna element 13. However, a first antenna element 13 need not be provided.

FIG. 12 illustrates the first transmission line 11 applied to a transmission line in an antenna 1. However, the first transmission line 11 may be applied to a transmission line other than that in an antenna.

For example, the transmission line according to an embodiment in the present disclosure may be a power supply line for a first antenna element in a multiantenna.

Figure 13:
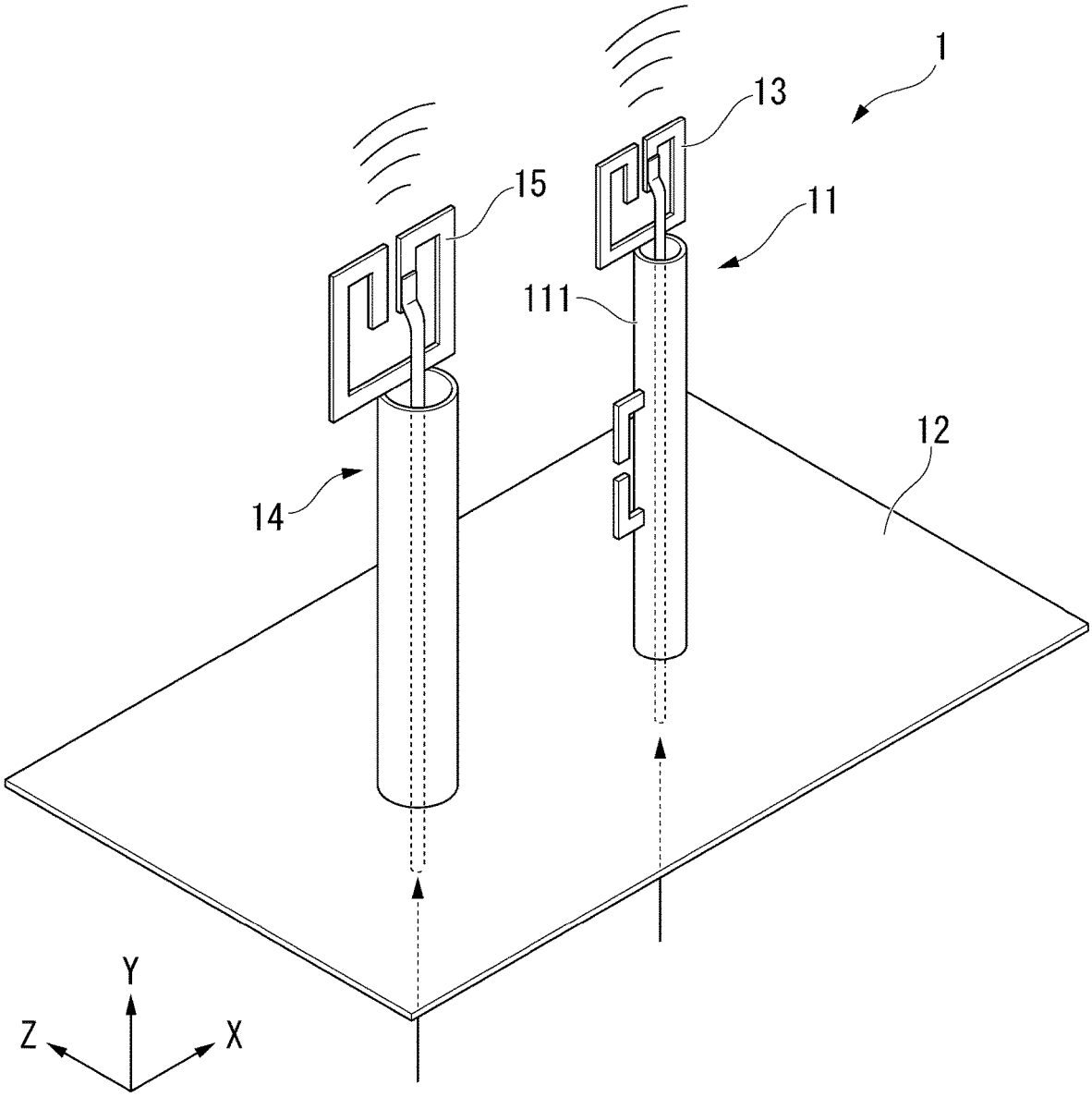
FIG. 13 is a perspective view of an example of a transmission line according to an embodiment in the present disclosure.

FIG. 13 is a perspective view of an example of a transmission line according to an embodiment in the present disclosure.

Figure 14:
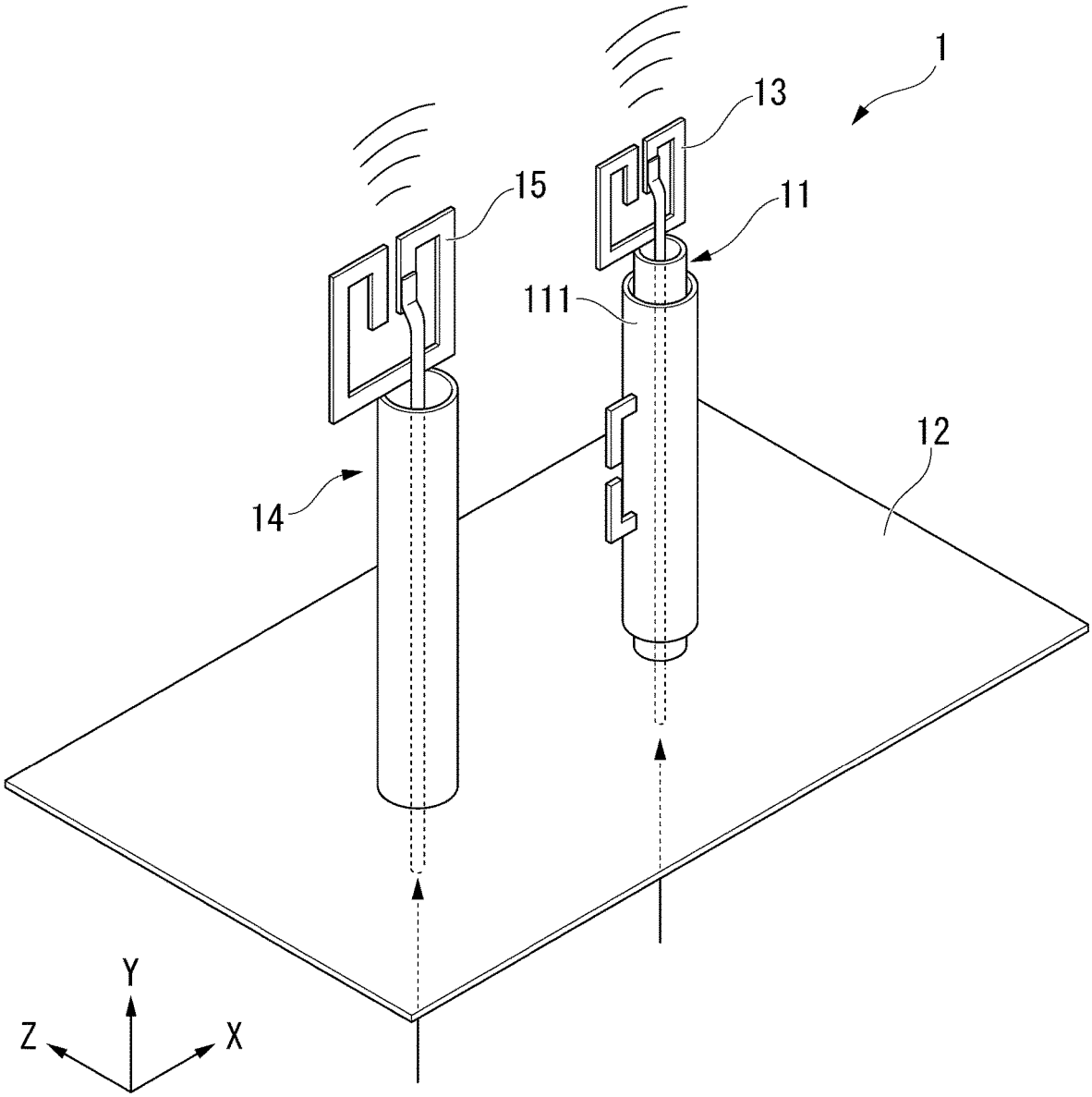
FIG. 14 is a perspective view of an example of a transmission line according to an embodiment in the present disclosure.

FIG. 14 is a perspective view of an example of a transmission line according to an embodiment in the present disclosure.

Figure 15:
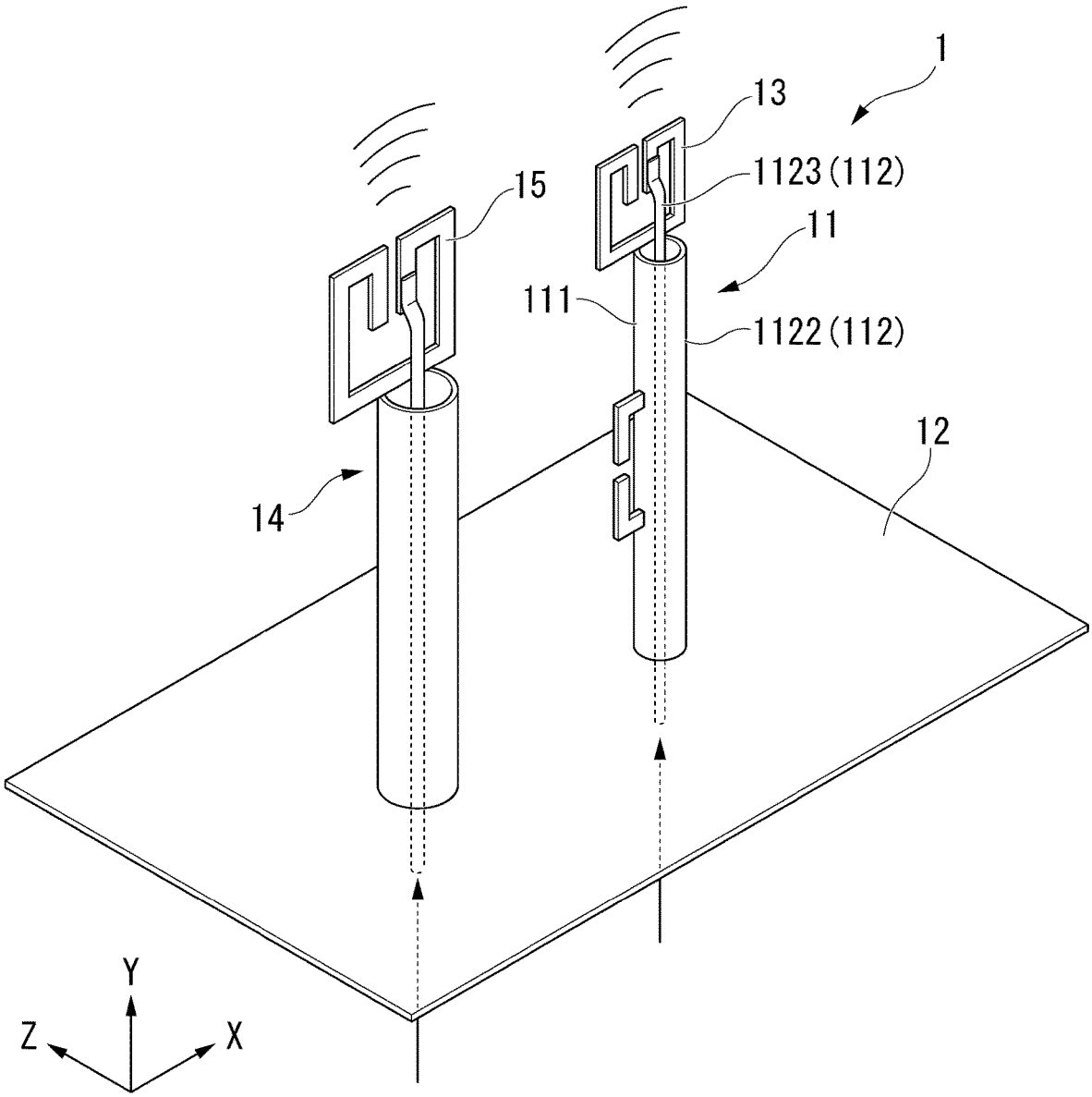
FIG. 15 is a perspective view of an example of a transmission line according to an embodiment in the present disclosure.

FIG. 15 is a perspective view of an example of a transmission line according to an embodiment in the present disclosure.

Figure 16:
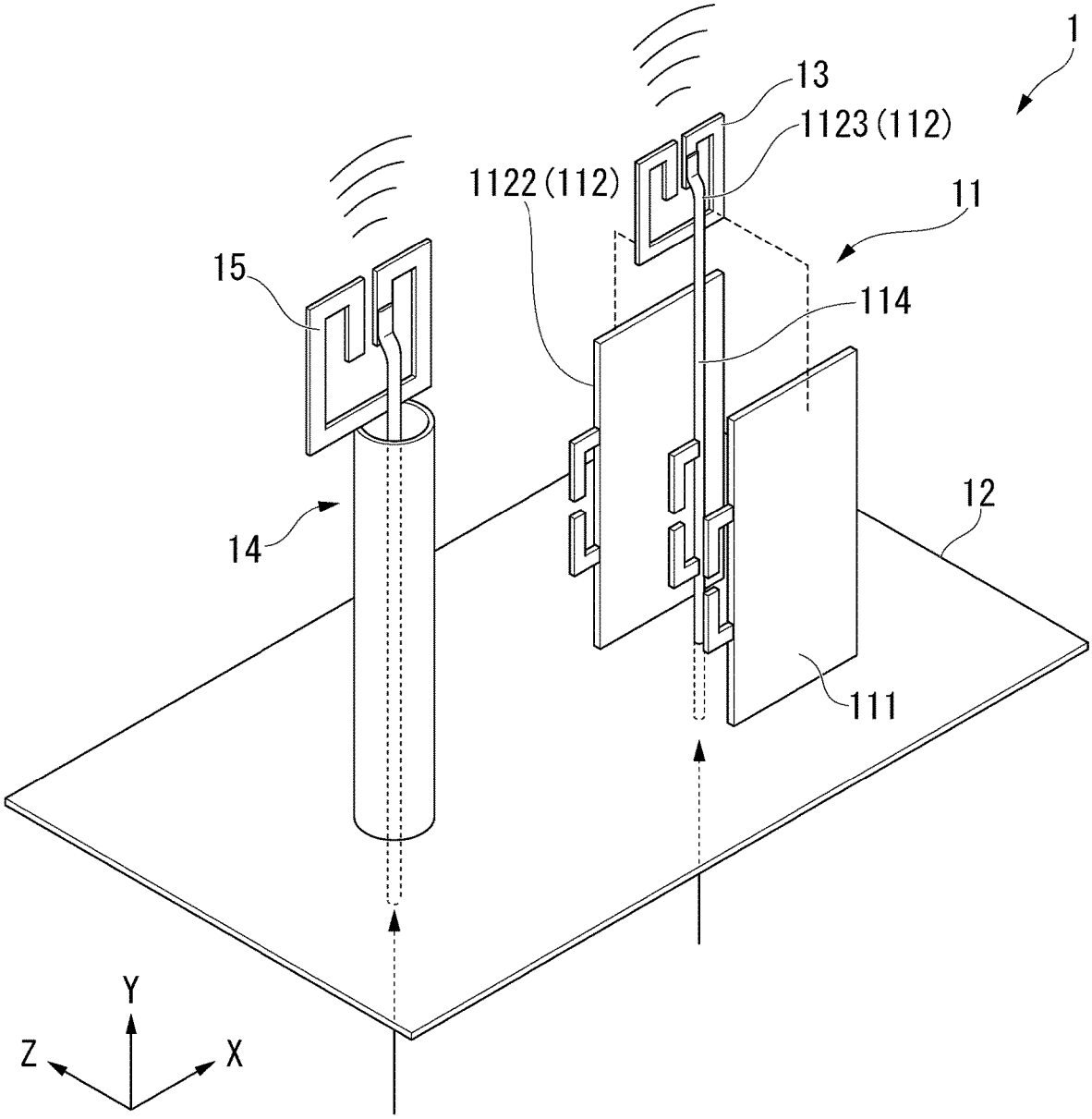
FIG. 16 is a perspective view of an example of a transmission line according to an embodiment in the present disclosure.

FIG. 16 is a perspective view of an example of a transmission line according to an embodiment in the present disclosure.

For example, the first transmission line 11 may be a power supply line for a first antenna element 13 in a multiantenna.

For example, the antenna 1 may be provided with a first transmission line 11, a first antenna element 13, a second transmission line 14, and a second antenna element 15.

For example, the electromagnetic waves transmitted on the first transmission line 11 and the electromagnetic waves transmitted on the second transmission line 14 may both penetrate through the reflective plate 12.

For example, the electromagnetic waves supplied to the first transmission line 11 may be radiated from the first antenna element 13 and the electromagnetic waves supplied to the second transmission line 14 may be radiated from the second antenna element 15.

For example, the first transmission line 11 may be able to supply electromagnetic waves to the first antenna element 13 while also being made transparent with respect to electromagnetic waves of a certain frequency in the multiantenna. In other words, electromagnetic waves of the certain frequency in the multiantenna may pass through the first transmission line 11.

The first transmission line 11 may be able to supply electromagnetic waves to the first antenna element 13 while also being made transparent with respect to electromagnetic waves of a certain frequency in the multiantenna.

For this reason, the first transmission line 11 can suppress the adverse influence that may have on electromagnetic waves of a certain frequency.

Therefore, according to the embodiment in the present disclosure as above, for example, the transmission line will not tend to affect the characteristics of electromagnetic waves of a certain frequency in a multiantenna.

FIG. 13, FIG. 14, FIG. 15 and FIG. 16 illustrate reflective plates 12. However, a reflective plate 12 need not be provided as long as the first transmission line 11 can be made transparent.

The second transmission lines 14 illustrated in FIG. 13, FIG. 14, FIG. 15 and FIG. 16 do not have frequency-selecting surfaces. However, they may have frequency-selecting surfaces.

The second transmission lines 14 illustrated in FIG. 13, FIG. 14, FIG. 15 and FIG. 16 may allow electromagnetic waves of a certain frequency to pass.

For example, in an embodiment in the present disclosure, the transmission line may be a power supply line for a first antenna element in a multiantenna, wherein the multiantenna supports electromagnetic waves of a first frequency and electromagnetic waves of a second frequency, and the transmission line allows electromagnetic waves of the first frequency to pass and supplies electromagnetic waves of the second frequency to the first antenna element.

Figure 17:
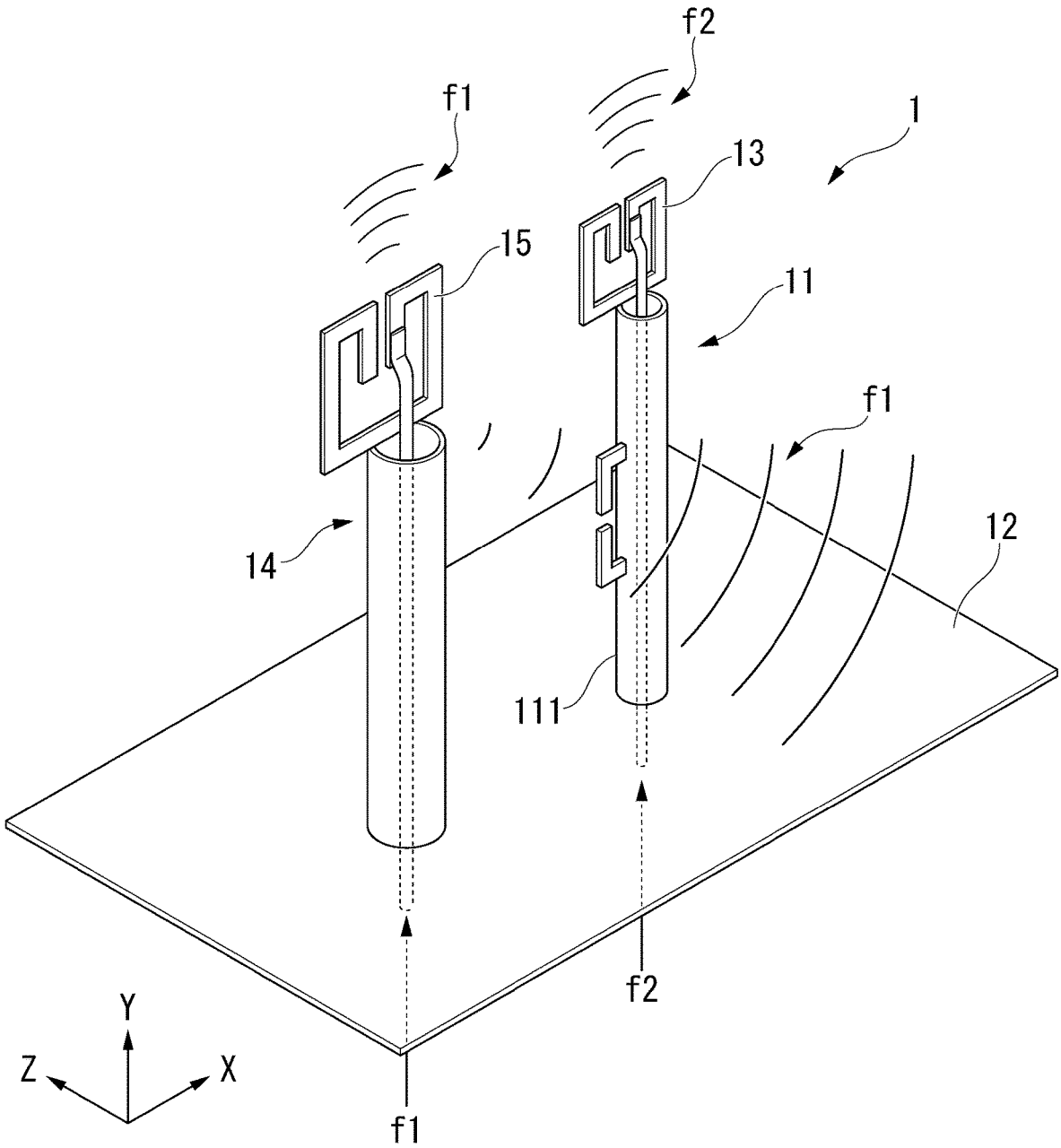
FIG. 17 is a perspective view of an example of a transmission line according to an embodiment in the present disclosure.

FIG. 17 is a perspective view of an example of a transmission line according to an embodiment in the present disclosure.

Figure 18:
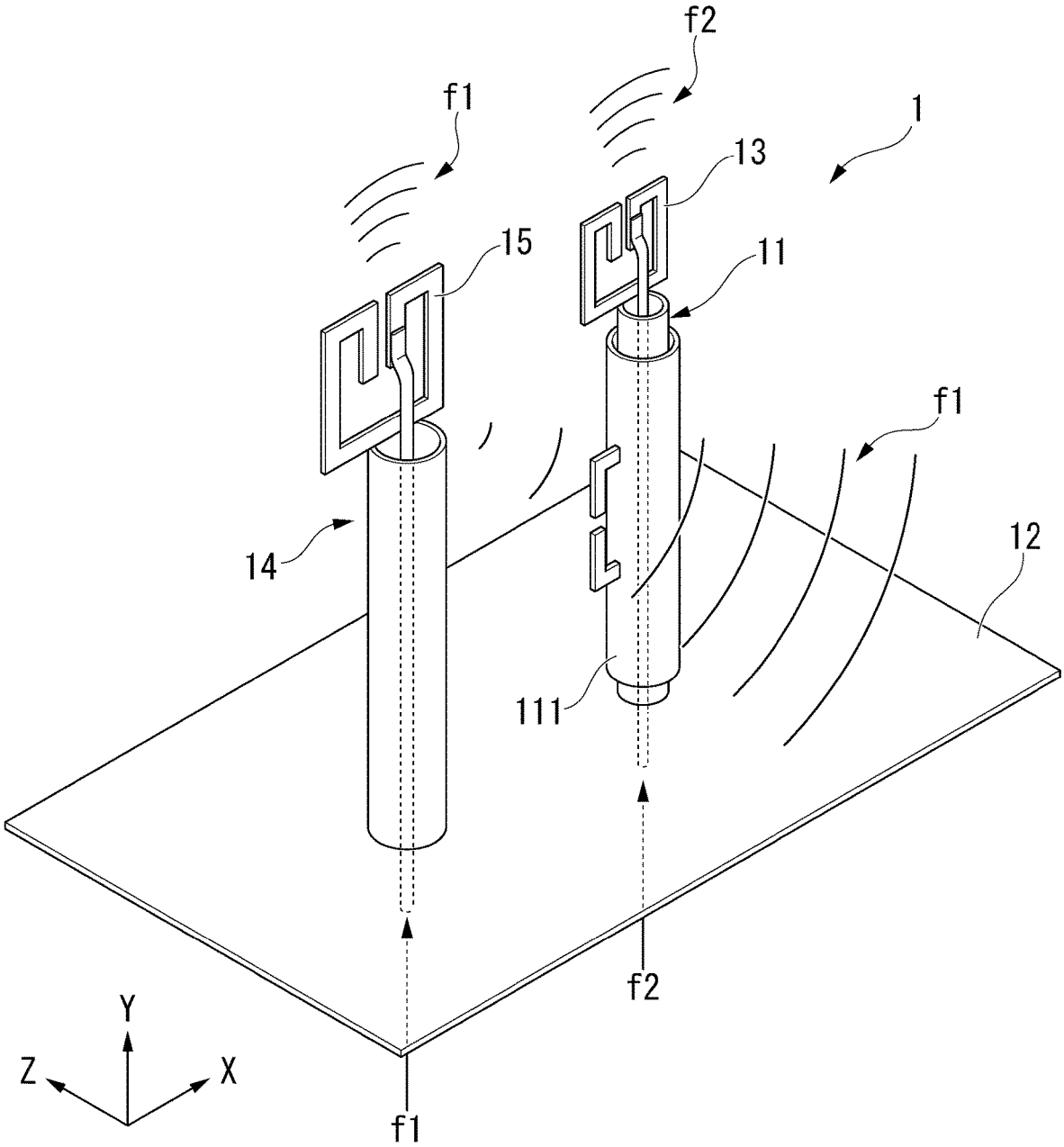
FIG. 18 is a perspective view of an example of a transmission line according to an embodiment in the present disclosure.

FIG. 18 is a perspective view of an example of a transmission line according to an embodiment in the present disclosure.

Figure 19:
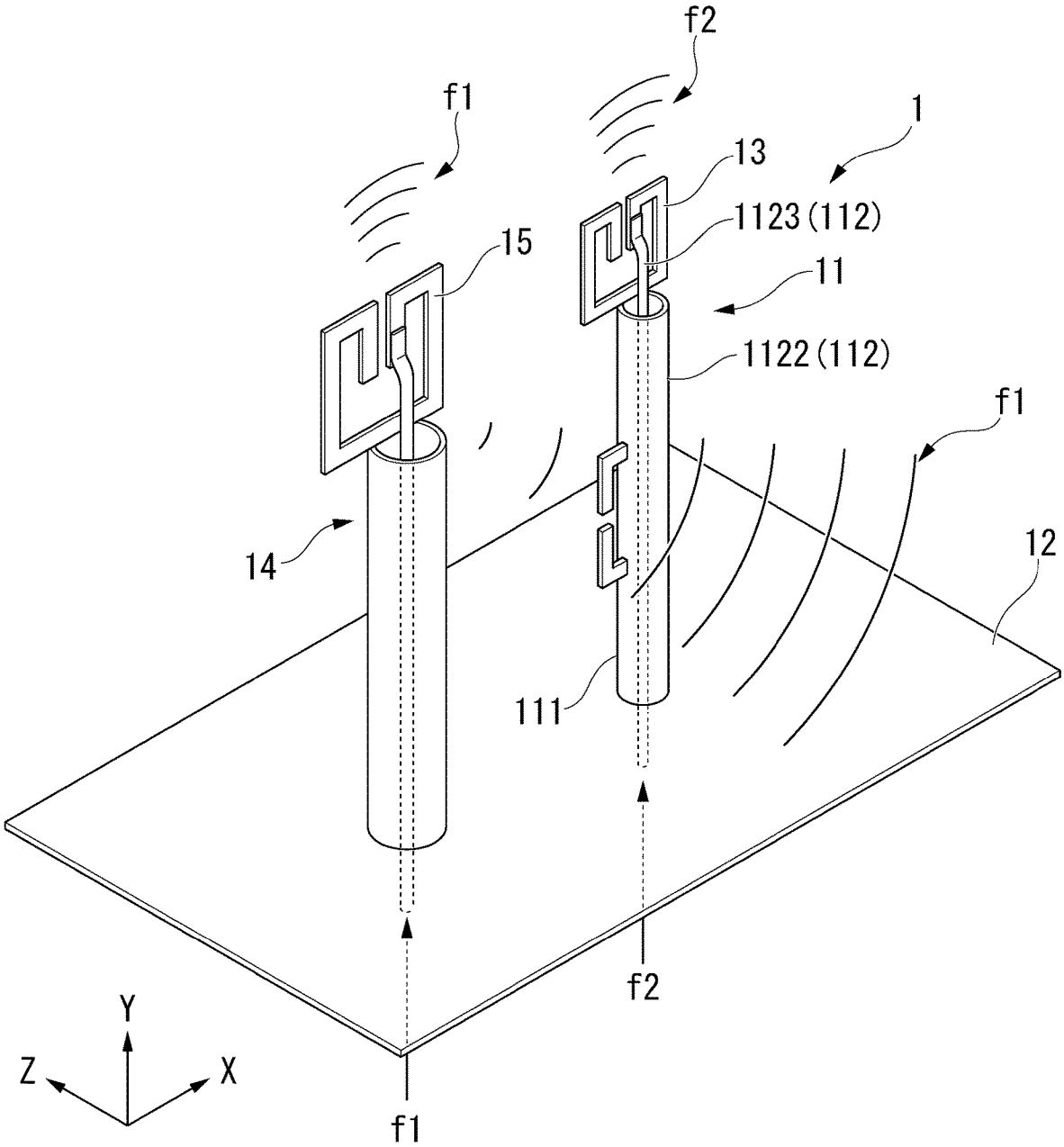
FIG. 19 is a perspective view of an example of a transmission line according to an embodiment in the present disclosure.

FIG. 19 is a perspective view of an example of a transmission line according to an embodiment in the present disclosure.

Figure 20:
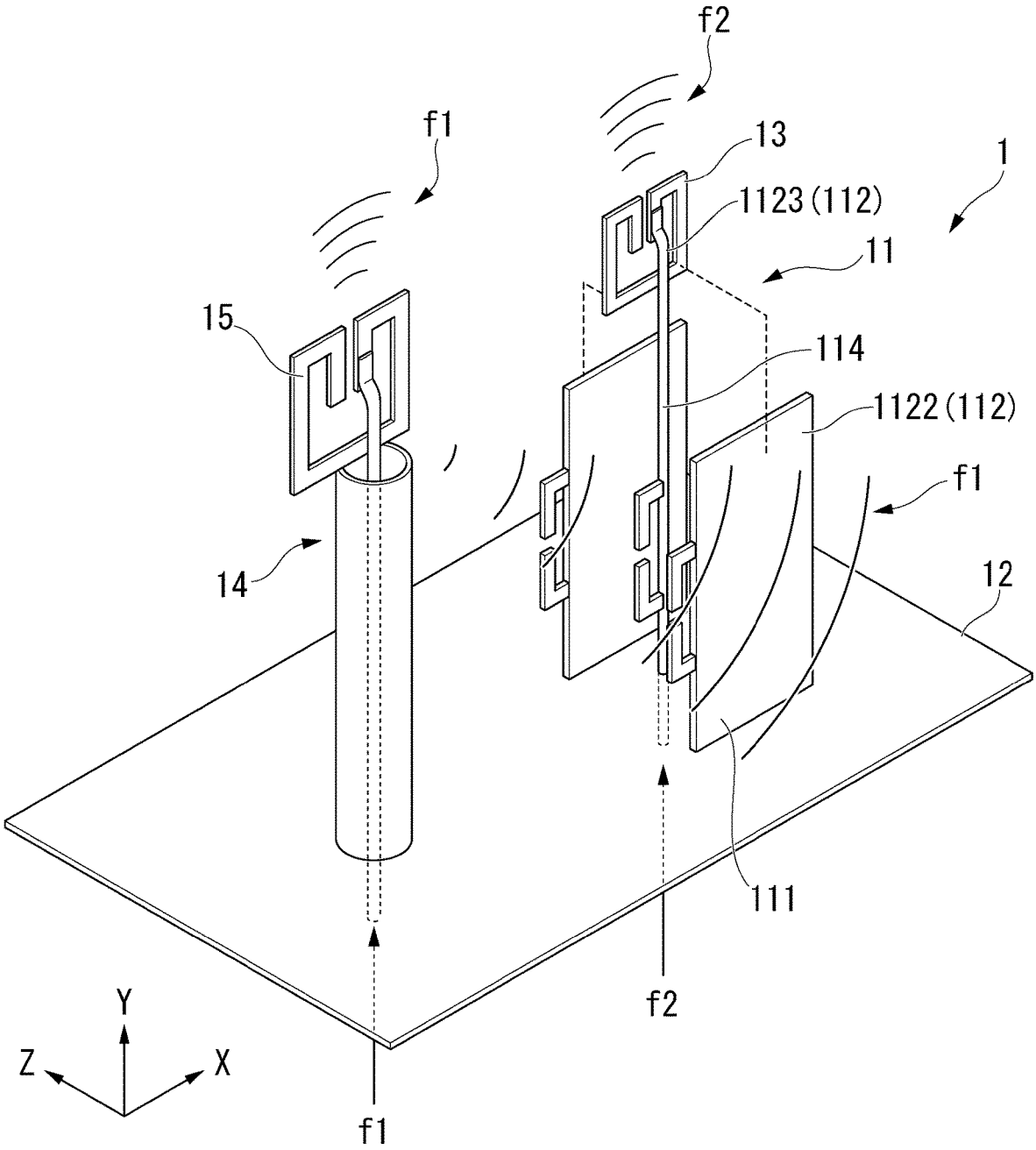
FIG. 20 is a perspective view of an example of a transmission line according to an embodiment in the present disclosure.

FIG. 20 is a perspective view of an example of a transmission line according to an embodiment in the present disclosure.

For example, the first transmission line 11 may be a power supply line for a first antenna element 13 in a multiantenna that supports electromagnetic waves of a first frequency f1 and electromagnetic waves of a second frequency f2.

For example, the first transmission line 11 may allow electromagnetic waves of the first frequency f1 to pass and may supply electromagnetic waves of the second frequency f2 to the first antenna element 13.

For example, the electromagnetic waves of the second frequency f2 are electromagnetic waves of a frequency in a different frequency band from the electromagnetic waves of the first frequency f1.

For example, the first antenna element 13 may radiate electromagnetic waves of the second frequency f2.

For example, the second transmission line 14 may supply electromagnetic waves of the first frequency f1 to the second antenna element 15.

For example, the second antenna element 15 may radiate electromagnetic waves of the first frequency f1.

The first transmission line 11 may be able to supply electromagnetic waves of the second frequency f2 to the first antenna element 13 while also being made transparent with respect to electromagnetic waves of the first frequency f1 in the multiantenna. For this reason, the first transmission line 11 can suppress the adverse influence that may have on electromagnetic waves of the first frequency f1 supported by the multiantenna.

Thus, according to each of the embodiments in FIG. 17 to FIG. 20, the first transmission line 11 can supply electromagnetic waves of the second frequency f2 to the first antenna element 13, and is made transparent with respect to electromagnetic waves of the first frequency f1 in the multiantenna.

Therefore, according to the embodiment in the present disclosure as above, for example, the transmission line can supply electromagnetic waves of the second frequency that are radiated while also not tending to affect the characteristics of the electromagnetic waves of the first frequency supported by the multiantenna.

Figure 21:
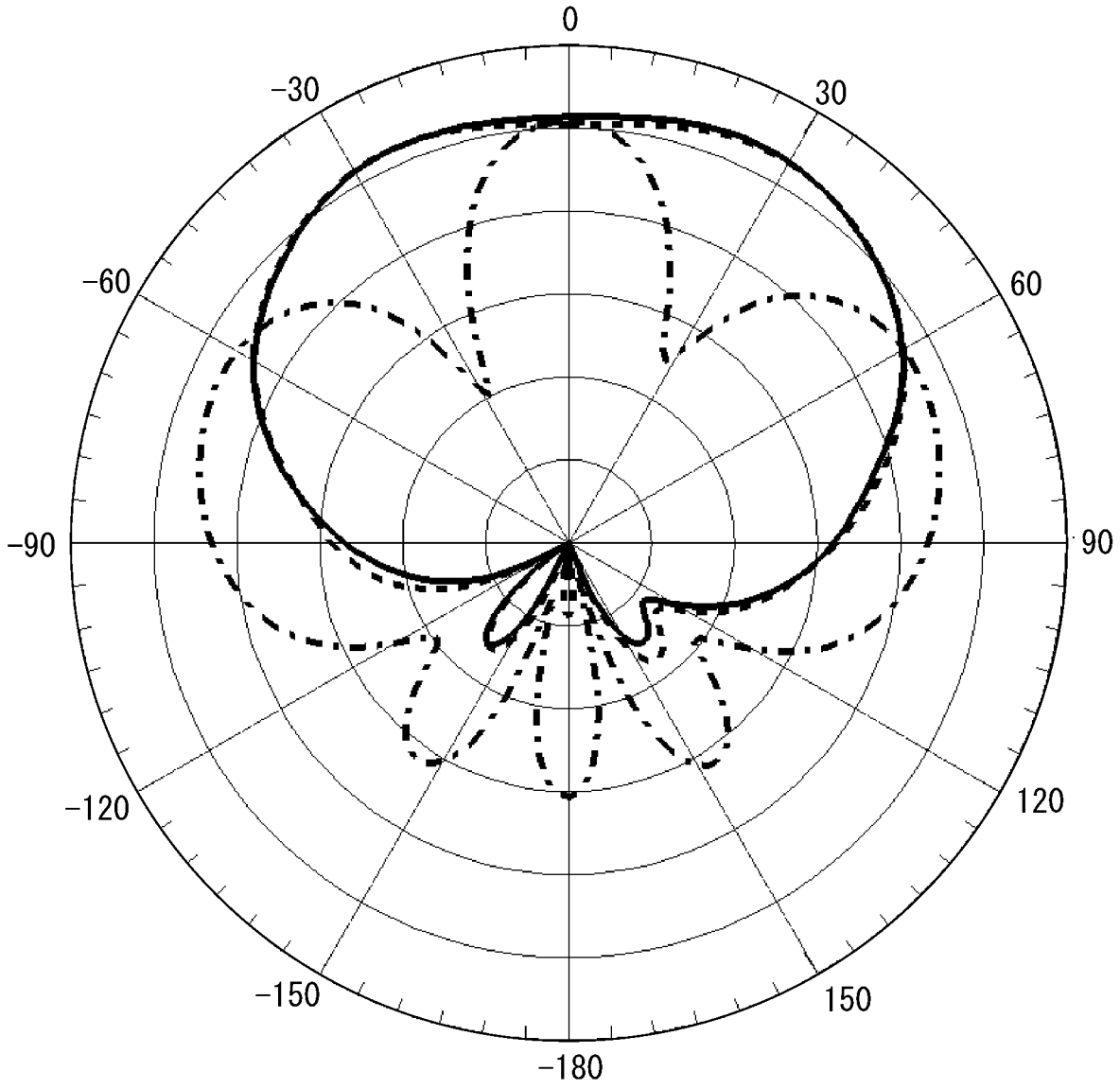
FIG. 21 is an example of a radiation pattern of a second antenna element according to an embodiment in the present disclosure.

FIG. 21 is an example of the radiation pattern of the second antenna element 15 according to an embodiment in the present disclosure.

For example, the solid lines indicate the radiation pattern of electromagnetic waves of the first frequency f1 in the second antenna element 15 in the antenna 1 illustrated in FIG. 17. In other words, the solid lines indicate the radiation pattern of the electromagnetic waves of the first frequency in the second antenna element when there is a first frequency-selecting surface on the first transmission line.

For example, the dashed lines indicate the radiation pattern of electromagnetic waves of the first frequency f1 in the second antenna element 15 when the first transmission line 11 is not provided in the antenna 1 illustrated in FIG. 17. In other words, the dashed lines indicate the radiation pattern of the electromagnetic waves of the first frequency f1 in the second antenna element 15 when only the second antenna element 15 is provided.

For example, the single-dotted chain lines indicate the radiation pattern of electromagnetic waves of the first frequency f1 in the second antenna element 15 when the first frequency-selecting surface 111 is not provided on the first transmission line 11 in the antenna 1 illustrated in FIG. 17. In other words, the single-dotted chain lines indicate the radiation pattern of the electromagnetic waves of the first frequency f1 in the second antenna element 15 when a frequency-selecting surface 111 is not provided on the first transmission line 11.

As can be understood from the comparison results indicated in FIG. 21, the radiation pattern of the single-dotted chain lines is significantly changed in comparison to the radiation pattern of the dashed lines, whereas the radiation pattern of the solid lines is almost unchanged in comparison to the radiation pattern of the dashed lines. In this way, the first transmission line suppresses the adverse influence that may have on electromagnetic waves of the first frequency supported by the multiantenna.

FIG. 17, FIG. 18, FIG. 19 and FIG. 20 illustrate reflective plates 12. However, a reflective plate 12 need not be provided as long as the first transmission line 11 can be made transparent.

The second transmission lines 14 illustrated in FIG. 17, FIG. 18, FIG. 19 and FIG. 20 do not have frequency-selecting surfaces. However, they may have frequency-selecting surfaces.

For example, the second transmission lines 14 illustrated in FIG. 17, FIG. 18, FIG. 19 and FIG. 20 may allow electromagnetic waves of the second frequency f2 to pass.

In this case, the second transmission line 14 can supply electromagnetic waves of the first frequency f1 to the second antenna element 15 while also being made transparent with respect to electromagnetic waves of the second frequency f2 in the multiantenna.

For example, in an embodiment in the present disclosure, the transmission line is a power supply line for a first antenna element in a multiantenna, wherein the multiantenna supports electromagnetic waves of a first frequency and electromagnetic waves of a second frequency. The transmission line may allow electromagnetic waves of the first frequency to pass, supply electromagnetic waves of the second frequency to the first antenna element, and allows electromagnetic waves of the second frequency to pass.

Figure 22:
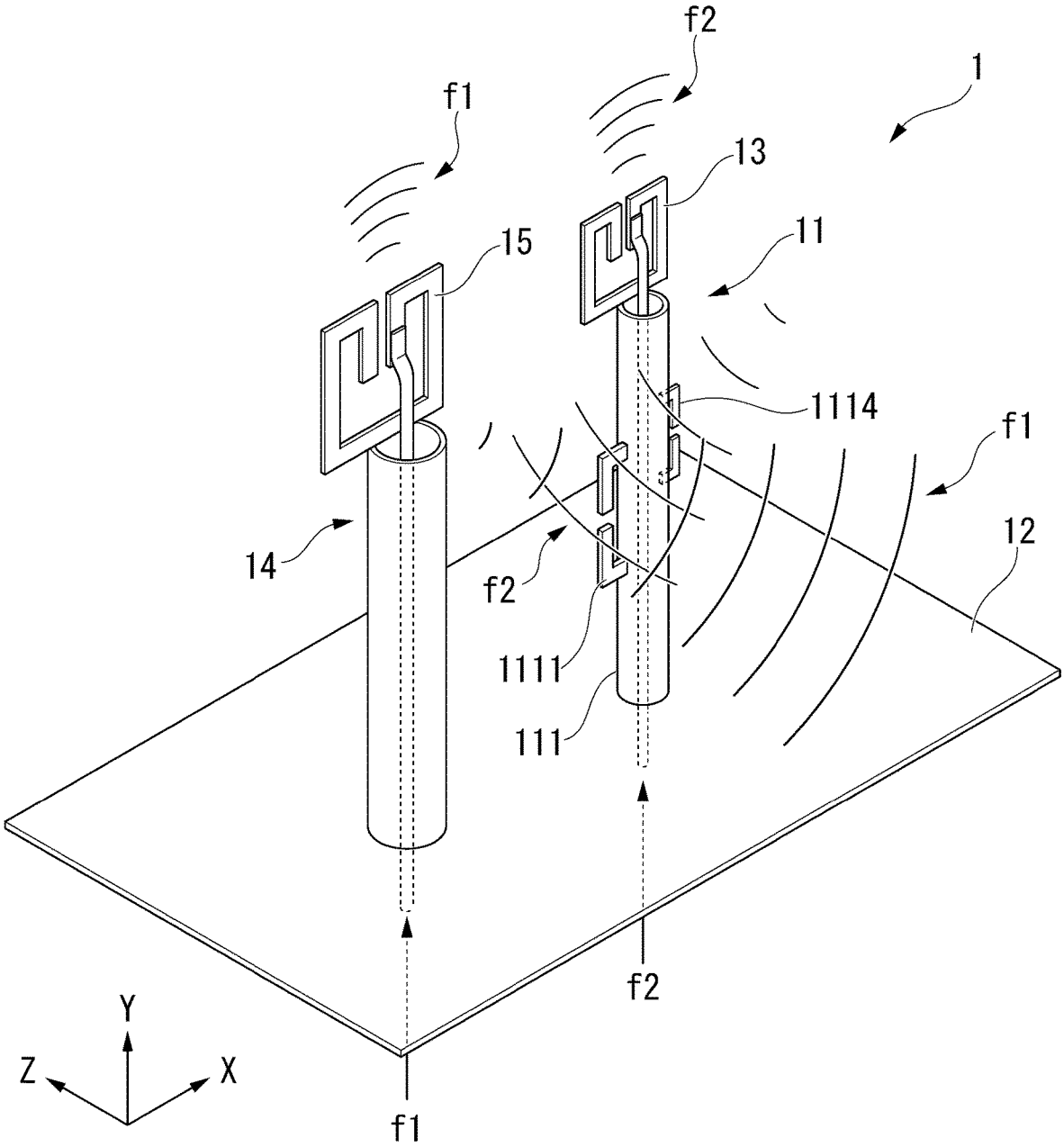
FIG. 22 is a perspective view of an example of a transmission line according to an embodiment in the present disclosure.

FIG. 22 is a perspective view of an example of a transmission line according to an embodiment in the present disclosure.

Figure 23:
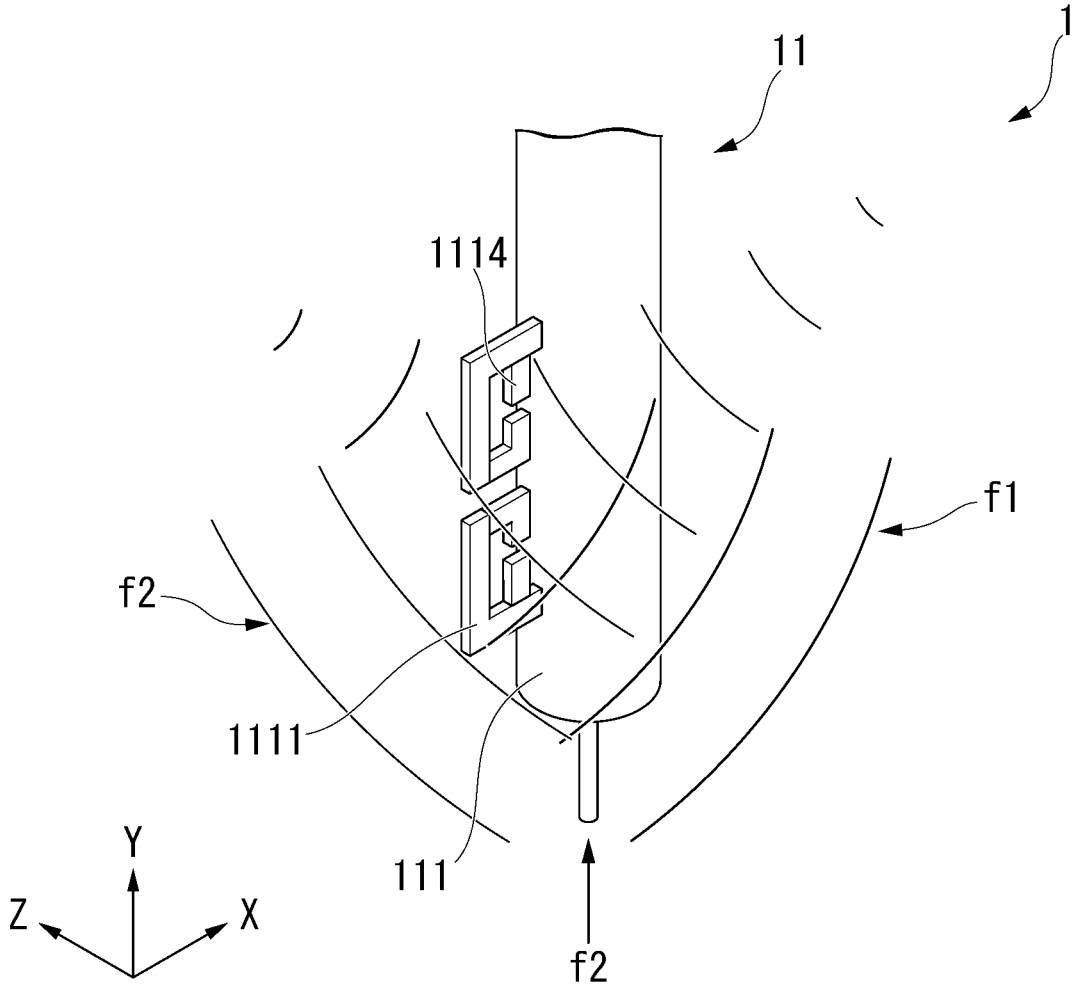
FIG. 23 is a perspective view of an example of a transmission line according to an embodiment in the present disclosure.

FIG. 23 is a perspective view of an example of a transmission line according to an embodiment in the present disclosure.

Figure 24:
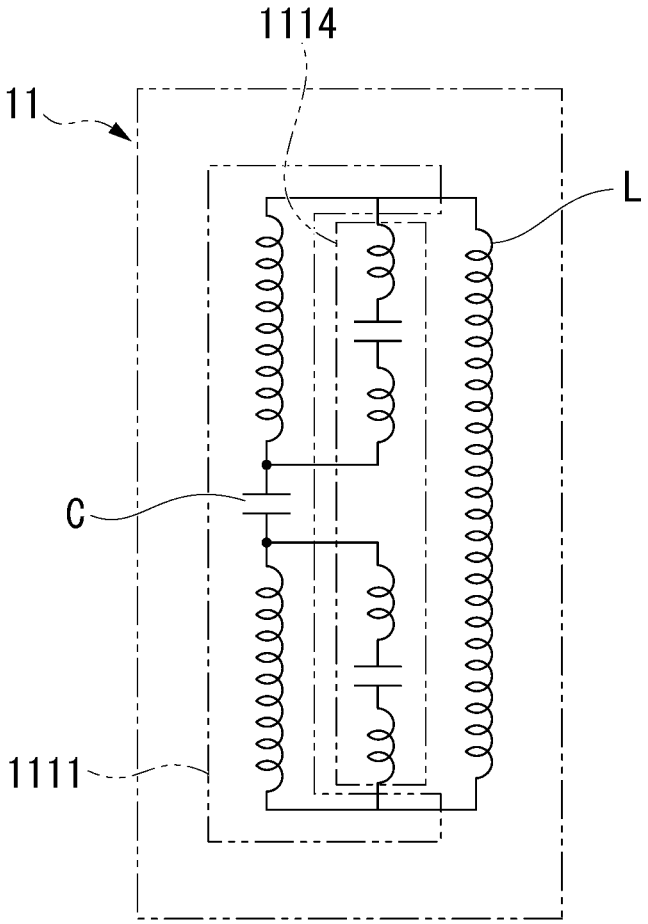
FIG. 24 is an example of an equivalent circuit of a transmission line according to an embodiment in the present disclosure.

FIG. 24 is an example of an equivalent circuit of a transmission line according to an embodiment in the present disclosure.

Figure 25:
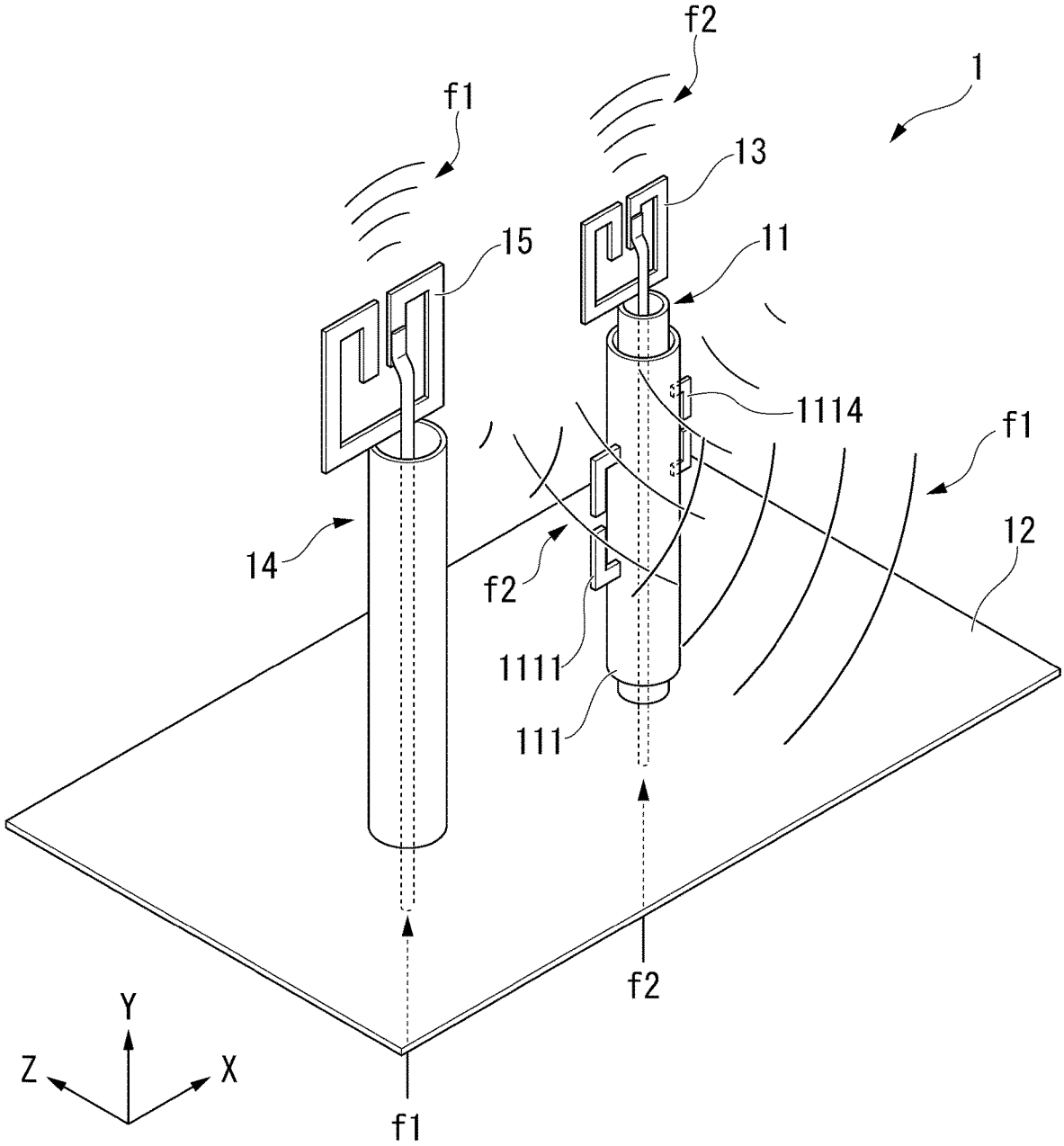
FIG. 25 is a perspective view of an example of a transmission line according to an embodiment in the present disclosure.

FIG. 25 is a perspective view of an example of a transmission line according to an embodiment in the present disclosure.

Figure 26:
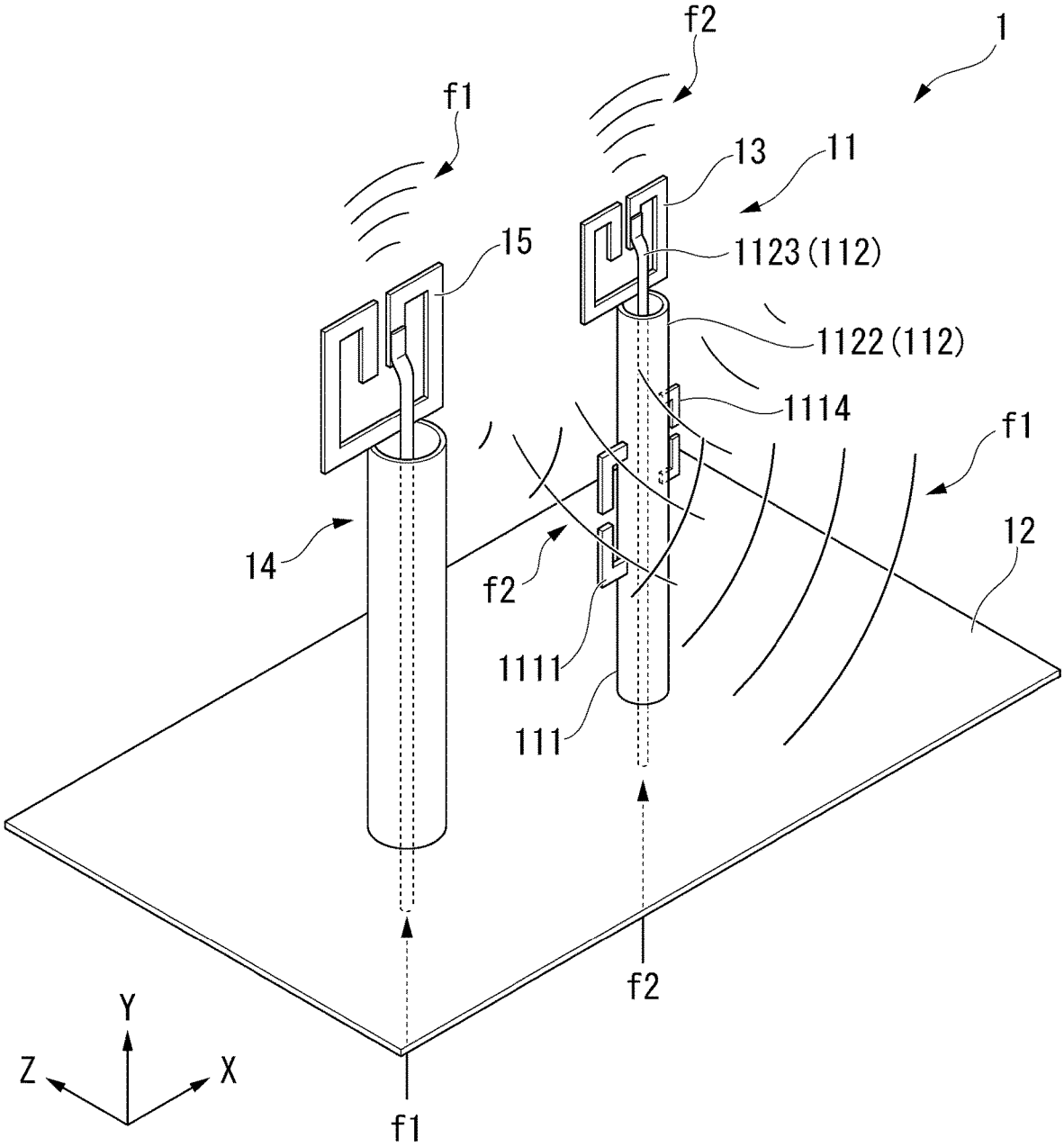
FIG. 26 is a perspective view of an example of a transmission line according to an embodiment in the present disclosure.

FIG. 26 is a perspective view of an example of a transmission line according to an embodiment in the present disclosure.

For example, the first transmission line 11 may be a power supply line for a first antenna element 13 in a multiantenna that supports electromagnetic waves of the first frequency f1 and electromagnetic waves of the second frequency f2.

For example, the first transmission line 11 may allow electromagnetic waves of the first frequency f1 to pass, supply electromagnetic waves of the second frequency f2 to the first antenna element 13, and allow electromagnetic waves of the second frequency f2 to pass.

For example, electromagnetic waves of the second frequency f2 are electromagnetic waves of a frequency in a different frequency band from the electromagnetic waves of the first frequency f1.

For example, the first antenna element 13 may radiate electromagnetic waves of the second frequency f2.

For example, the second transmission line 14 may supply electromagnetic waves of the first frequency f1 to the second antenna element 15.

For example, the second antenna element 15 may radiate electromagnetic waves of the first frequency f1.

For example, the first frequency-selecting surface 111 may be configured so that the first transmission line 11 allows electromagnetic waves of the first frequency f1 and electromagnetic waves of the second frequency f2 to pass.

For example, the first frequency-selecting surface 111 may include a three-dimensional pattern 1111 and an auxiliary pattern 1114.

For example, the first frequency-selecting surface 111 may allow electromagnetic waves of the first frequency f1 and electromagnetic waves of the second frequency f2 to pass by a combination of the surface of the ground conductor 1122, the three-dimensional pattern 1111, and the auxiliary pattern 1114.

For example, as illustrated in FIG. 22, of both sides in a radial direction of the first transmission line 11, the three-dimensional pattern 1111 may be provided on one side and the auxiliary pattern 1114 of an L-shape metallic plate may be provided on the other side.

For example, of both sides in a radial direction of the first transmission line 11, the three-dimensional pattern 1111 may be provided on one end and the auxiliary pattern 1114 may be provided on the other end.

For example, as illustrated in FIG. 23, the three-dimensional pattern 1111 may be provided on a surface of the first transmission line 11, and the auxiliary pattern 1114 may be provided in a space formed between the surface of the first transmission line 11 and the three-dimensional pattern 1111.

For example, the three-dimensional pattern 1111 may be provided on a surface of the first transmission line 11 and the auxiliary pattern 1114 may be provided in a space formed between the surface of the first transmission line 11 and the three-dimensional pattern 1111 so as to form the LC circuit illustrated in FIG. 24.

For example, the respective metallic plates in the three-dimensional pattern 1111 may be provided so that the plate surfaces of L-shaped metallic plates in the three-dimensional pattern 1111 extend along the XY plane.

For example, the respective metallic plates in the auxiliary pattern 1114 may be provided so that the plate surfaces of the metallic plates in the auxiliary pattern 1114 extend along the XY plane.

For example, the auxiliary pattern 1114 may be a combination of an L-shaped metallic plate and an I-shaped metallic plate.

The first transmission line 11 can supply electromagnetic waves of the second frequency f2 to the first antenna element 13, and is made transparent with respect to electromagnetic waves of the first frequency f1 in the multiantenna, and with respect to electromagnetic waves of the second frequency f2 in the multiantenna.

For this reason, the first transmission line 11 can suppress the adverse influence that may have on electromagnetic waves of the first frequency f1 and the second frequency f2 supported by the multiantenna.

If a frequency-selecting surface is provided in order to make the transmission line transparent with respect to electromagnetic waves of the first frequency f1, the frequency-selecting surface sometimes adversely affects electromagnetic waves of the second frequency f2 radiated through the transmission of the transmission line itself.

In contrast therewith, the first transmission line 11 according to an embodiment in the present disclosure is made transparent with respect to electromagnetic waves of the first frequency f1 and the second frequency f2. For this reason, it is possible to suppress the adverse influence that may have on electromagnetic waves of the second frequency f2 radiated through the transmission of the first transmission line 11 itself.

Therefore, according to the embodiment in the present disclosure as above, for example, even when the transmission line is provided in a space through which electromagnetic waves travel, the transmission line does not tend to affect the characteristics of electromagnetic waves of the first frequency and the second frequency.

FIG. 22, FIG. 25 and FIG. 26 illustrate reflective plates 12. However, a reflective plate 12 need not be provided as long as the first transmission line 11 can be made transparent.

The second transmission lines 14 illustrated in FIG. 22, FIG. 25 and FIG. 26 do not have frequency-selecting surfaces. However, they may have the frequency-selecting surfaces.

The second transmission lines 14 illustrated in FIG. 22, FIG. 25 and FIG. 26 do not have frequency-selecting surfaces. However, they may be configured so as to have the frequency-selecting surfaces and may allow electromagnetic waves of the second frequency f2 to pass.

The second transmission lines 14 illustrated in FIG. 22, FIG. 25 and FIG. 26 do not have frequency-selecting surfaces. However, they may be configured so as to have the frequency-selecting surfaces and may allow electromagnetic waves of the first frequency f1 and the second frequency f2 to pass.

The three-dimensional patterns 1111 illustrated in FIG. 22, FIG. 23, FIG. 25 and FIG. 26 are provided on one side in a radial direction of the ground conductors 1122. However, they may be provided on both sides in the radial direction of the ground conductors 1122.

The auxiliary patterns 1114 illustrated in FIG. 22, FIG. 23, FIG. 25 and FIG. 26 are provided on one side in a radial direction of the ground conductors 1122. However, they may be provided on both sides in the radial direction of the ground conductors 1122. FIG. 22, FIG. 23, FIG. 25 and FIG. 26 illustrate first frequency-selecting surfaces 111 including three-dimensional patterns 1111 and auxiliary patterns 1114. However, they may have any configuration as long as the first transmission lines 11 can be made transparent with respect to electromagnetic waves of the first frequency f1 and the second frequency f2.

For example, the first frequency-selecting surfaces 111 may include grid patterns comprising repeating structures so that electromagnetic waves of the first frequency f1 and the second frequency f2 are passed.

INDUSTRIAL APPLICABILITY

According to an embodiment in the present disclosure, for example, even when a transmission line is provided in a space through which electromagnetic waves travel, the characteristics of the electromagnetic waves are not easily affected.

REFERENCE SIGNS LIST

1 Antenna
11 First transmission line (transmission line)
111 First frequency-selecting surface
1111 Three-dimensional pattern
1112 Grid pattern
1114 Auxiliary pattern
112 Conductor
1122 Ground conductor
11221 Planar pattern
11222 Via-hole
11223 Lead wire
1123 Core wire
114 Second frequency-selecting surface
1141 Three-dimensional pattern
1142 Lattice pattern
12 Reflective plate
13 First antenna element
14 Second transmission line
15 Second antenna element
C Capacitance component
L Inductance component
P Polarization direction

The invention claimed is:

1. A transmission line having:

a first frequency-selecting surface that covers an outer circumference of a conductor; and a second frequency-selecting surface provided on a core wire located inside the conductor, wherein the second frequency-selecting surface is configured to allow electromagnetic waves to pass of a same frequency band as electromagnetic waves passed by the first frequency-selecting surface.

2. The transmission line according to claim 1, wherein the first frequency-selecting surface is provided on a ground conductor.

3. The transmission line according to claim 1, wherein the transmission line is a power supply line for a first antenna element in a multi-antenna.

4. The transmission line according to claim 3, wherein the multi-antenna supports electromagnetic waves of a first frequency and electromagnetic waves of a second frequency; and wherein the transmission line is configured to:

allow the electromagnetic waves of the first frequency to pass; and supply the electromagnetic waves of the second frequency to the first antenna element.

5. The transmission line according to claim 1, wherein the transmission line is a power supply line for a first antenna element in a multi-antenna;

wherein the multi-antenna supports electromagnetic waves of a first frequency and electromagnetic waves of a second frequency;

wherein the transmission line is configured to:

allow the electromagnetic waves of the first frequency to pass;

supply the electromagnetic waves of the second frequency to the first antenna element; and allow the electromagnetic waves of the second frequency to pass.

6. An antenna comprising:

a transmission line having:

a first frequency-selecting surface that covers an outer circumference of a conductor; and a second frequency-selecting surface provided on a core wire located inside the conductor, wherein the second frequency-selecting surface is configured to allow electromagnetic waves to pass of a same frequency band as electromagnetic waves passed by the first frequency-selecting surface; and a reflective plate.

* * * * *